US008960443B2

(12) United States Patent
Mankosa et al.

(10) Patent No.: US 8,960,443 B2
(45) Date of Patent: Feb. 24, 2015

(54) FLOTATION SEPARATION DEVICE AND METHOD

(75) Inventors: Michael J. Mankosa, Erie, PA (US); Jaisen Kohmuench, Erie, PA (US); Eric S. Yan, Erie, PA (US); Gerald H. Luttrell, Blacksburg, VA (US)

(73) Assignee: Eriez Manufacturing Co., Erie, PA (US)

( * ) Notice: Subject to any disclaimer, the term of this patent is extended or adjusted under 35 U.S.C. 154(b) by 530 days.

(21) Appl. No.: 12/101,376

(22) Filed: Apr. 11, 2008

(65) Prior Publication Data

US 2008/0251427 A1 Oct. 16, 2008

Related U.S. Application Data

(60) Provisional application No. 60/911,327, filed on Apr. 12, 2007.

(51) Int. Cl.
*B03D 1/02* (2006.01)
*B03D 1/14* (2006.01)
(Continued)

(52) U.S. Cl.
CPC ..... *B03D 1/028* (2013.01); *B03D 1/082* (2013.01); *B03D 1/22* (2013.01); *B03D 1/247* (2013.01); *B03D 1/1487* (2013.01)
USPC ..... 209/164; 209/166; 209/169; 209/170

(58) Field of Classification Search
USPC ..... 209/164, 166
See application file for complete search history.

(56) References Cited

U.S. PATENT DOCUMENTS 1,157,176 A * 10/1915 Owen ..... 209/167
1,226,062 A * 5/1917 Colburn et al. ..... 209/169
(Continued)

FOREIGN PATENT DOCUMENTS

DE 3808154 9/1989
JP 06-154656 A * 6/1994
(Continued)

OTHER PUBLICATIONS

J. Pyecha et al "Evaluation of a Microcel sparger in the Red Dog column flotation cells", Minerals Engineering, 2006, vol. 19, pp. 748-757.*
(Continued)

*Primary Examiner* — Thomas M Lithgow
(74) *Attorney, Agent, or Firm* — Jonathan M. D'Silva; MacDonald, Illig, Jones & Britton LLP

(57) ABSTRACT

A flotation separation system is provided for partitioning a slurry that includes a hydrophobic species which can adhere to gas bubbles formed in the slurry. The flotation separation system comprises a flotation separation cell that includes a sparger unit and a separation tank. The sparger unit has a slurry inlet for receiving slurry and a gas inlet to receive gas with at least enough pressure to allow bubbles to form in the slurry within the sparger unit. The sparger unit includes a sparging mechanism constructed to disperse gas bubbles within the slurry. The sparging mechanism sparges the gas bubbles to form a bubble dispersion so as to cause adhesion of the hydrophobic species to the gas bubbles substantially within the sparger unit while causing a pressure drop of about 10 psig or less across the sparging mechanism. The sparger unit includes a slurry outlet to discharge the slurry and the bubble dispersion into the separation tank.

10 Claims, 24 Drawing Sheets

(51) Int. Cl.

| | |
|---|---|
| ***B03D 1/24*** | (2006.01) |
| ***B03D 1/22*** | (2006.01) |
| ***B03D 1/08*** | (2006.01) |

(56) References Cited

U.S. PATENT DOCUMENTS

| | | | | | |
|---|---|---|---|---|---|
| 1,468,226 | A | * | 9/1923 | Colburn et al. | 366/164.6 |
| 2,938,629 | A | | 5/1960 | Hollingsworth et al. | |
| 3,271,293 | A | | 9/1966 | Ward | |
| 3,539,000 | A | * | 11/1970 | Vogel | 209/164 |
| 4,214,982 | A | * | 7/1980 | Pfalzer | 209/164 |
| 4,226,706 | A | * | 10/1980 | Degner et al. | 209/170 |
| 4,287,137 | A | | 9/1981 | Sonoyama et al. | |
| 4,328,107 | A | | 5/1982 | Wright | |
| 4,399,028 | A | * | 8/1983 | Kile et al. | 209/164 |
| 4,521,349 | A | | 6/1985 | Weber et al. | |
| 4,545,892 | A | | 10/1985 | Cymbalisty et al. | |
| 4,639,313 | A | | 1/1987 | Zipperian | |
| 4,674,888 | A | | 6/1987 | Carlson | |
| 4,752,383 | A | | 6/1988 | McKay et al. | |
| 4,783,268 | A | | 11/1988 | Leung | |
| 4,871,448 | A | | 10/1989 | Dobryakov et al. | |
| 4,938,865 | A | | 7/1990 | Jameson | |
| 4,940,534 | A | | 7/1990 | Harrison | |
| 4,971,685 | A | | 11/1990 | Stanley et al. | |
| 4,981,582 | A | | 1/1991 | Yoon et al. | |
| 4,997,549 | A | | 3/1991 | Atwood | |
| 5,028,315 | A | | 7/1991 | Cruea et al. | |
| 5,096,572 | A | * | 3/1992 | Hwang | 209/164 |
| 5,122,261 | A | | 6/1992 | Hollingsworth | |
| 5,167,798 | A | * | 12/1992 | Yoon et al. | 209/170 |
| 5,188,726 | A | * | 2/1993 | Jameson | 209/164 |
| 5,294,003 | A | | 3/1994 | Hollingsworth | |
| 5,460,270 | A | | 10/1995 | Chan et al. | |
| 5,520,818 | A | | 5/1996 | Smith et al. | |
| 5,591,328 | A | * | 1/1997 | Bodnaras | 209/170 |
| 5,660,718 | A | | 8/1997 | Chudacek | |
| 5,672,267 | A | | 9/1997 | Terblanche | |
| 5,676,823 | A | | 10/1997 | McKay et al. | |
| 5,693,263 | A | | 12/1997 | Meekel et al. | |
| 5,702,612 | A | | 12/1997 | Wang | |
| 5,855,769 | A | | 1/1999 | Firth et al. | 209/164 |
| 5,928,125 | A | | 7/1999 | Ding et al. | |
| 6,004,386 | A | | 12/1999 | Grisham et al. | |
| 6,092,667 | A | | 7/2000 | Steinmuller et al. | |
| 6,126,836 | A | | 10/2000 | Ding et al. | |
| 6,372,140 | B2 | | 4/2002 | Kelly | |
| 6,793,079 | B2 | | 9/2004 | Khan et al. | |
| 2002/0000412 | A1 | | 1/2002 | Craddock et al. | |
| 2004/0150121 | A1 | | 8/2004 | Armstrong | |
| 2004/0245151 | A1 | | 12/2004 | Lilja et al. | |
| 2005/0051465 | A1 | | 3/2005 | Khan | |
| 2005/0284818 | A1 | | 12/2005 | Patterson et al. | |

FOREIGN PATENT DOCUMENTS

| | | |
|---|---|---|
| WO | WO 00/15343 | 3/2000 |
| WO | WO00/15343 | 3/2000 |
| WO | WO01/62392 | 8/2001 |

OTHER PUBLICATIONS

R. Q. Honaker Interim Final Technical Report Sep. 1, 1993 through Aug. 31, 1994 A Comparison Study of Column Flotation Technologies for Cleaning Illinois Coal 26 pages.

Examiner's First Report on Australian Patent Application No. 2008240254; Author: John Deuls, Date of Report: Jan. 2, 2012; 2 pages.

Notification of First Office Action from State Intellectual Property Office of P. R. China on Chinese Patent Application No. 200880006174.1; Date of Office Action: May 17, 2012; 5 pages; Translation by Gecheng & Co attached.

* cited by examiner

FLOTATION SEPARATION DEVICE AND METHOD

This application takes priority from U.S. provisional application 60/911,327 filed Apr. 12, 2007, which is incorporated herein by reference.

BACKGROUND

Flotation separators are used extensively throughout the minerals industry to partition and recover the constituent species within slurries. A slurry is a mixture of liquids (usually water) with various species having varying degrees of hydrophobicity. The species could be insoluble particulate matter such as coal, metals, clay, sand, etc. or soluble elements or compounds in solution. Flotation separators work on the principle that the various species within the slurry interact differently with bubbles formed in the slurry. Gas bubbles introduced into the slurry attach, either through physical or chemical means, to one or more of the hydrophobic species of the slurry. The bubble-hydrophobic species agglomerates are sufficiently buoyant to lift away from the remaining constituents and are removed for further processing to concentrate and recover the adhered species. Various methods used to achieve this process typically require significant energy to inject gas into the slurry and form a bubble dispersion.

SUMMARY

A flotation separation system is provided for partitioning a slurry that includes a hydrophobic species which can adhere to gas bubbles formed in the slurry. The flotation separation system comprises a flotation separation cell that includes a sparger unit and a separation tank. The sparger unit has a slurry inlet for receiving slurry and a gas inlet to receive gas with at least enough pressure to allow bubbles to form in the slurry within the sparger unit. The sparger unit includes a sparging mechanism constructed to disperse gas bubbles within the slurry. The sparging mechanism sparges the gas bubbles to form a bubble dispersion so as to cause adhesion of the hydrophobic species to the gas bubbles substantially within the sparger unit while causing a pressure drop of about 10 psig or less across the sparging mechanism. The sparger unit includes a slurry outlet to discharge the slurry and the bubble dispersion into the separation tank. The separation tank has sufficient capacity to allow the bubble dispersion to form a froth at the top of the separation tank. Various embodiments of the flotation separation system can include a center well that surrounds the sparging unit.

In one embodiment, the sparging mechanism of the sparger unit includes a high-shear element to help shear the bubbles formed in the slurry into a bubble dispersion. The high-shear element can include rotating high-shear elements or a combination of rotating and static high-shear elements. Rotating high shear elements can comprise a series of rotating elements along the length of the sparging unit. The high-shear element can alternatively comprise a series of grooved discs pressed together to form channels from the gas inlets to the slurry with gas passing through the channels to reach the slurry. Other possible embodiments and variations are discussed in more detail herein.

Those skilled in the art will realize that this invention is capable of embodiments that are different from those shown and that details of the devices and methods can be changed in various manners without departing from the scope of this invention. Accordingly, the drawings and descriptions are to be regarded as including such equivalent embodiments as do not depart from the spirit and scope of this invention.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1:
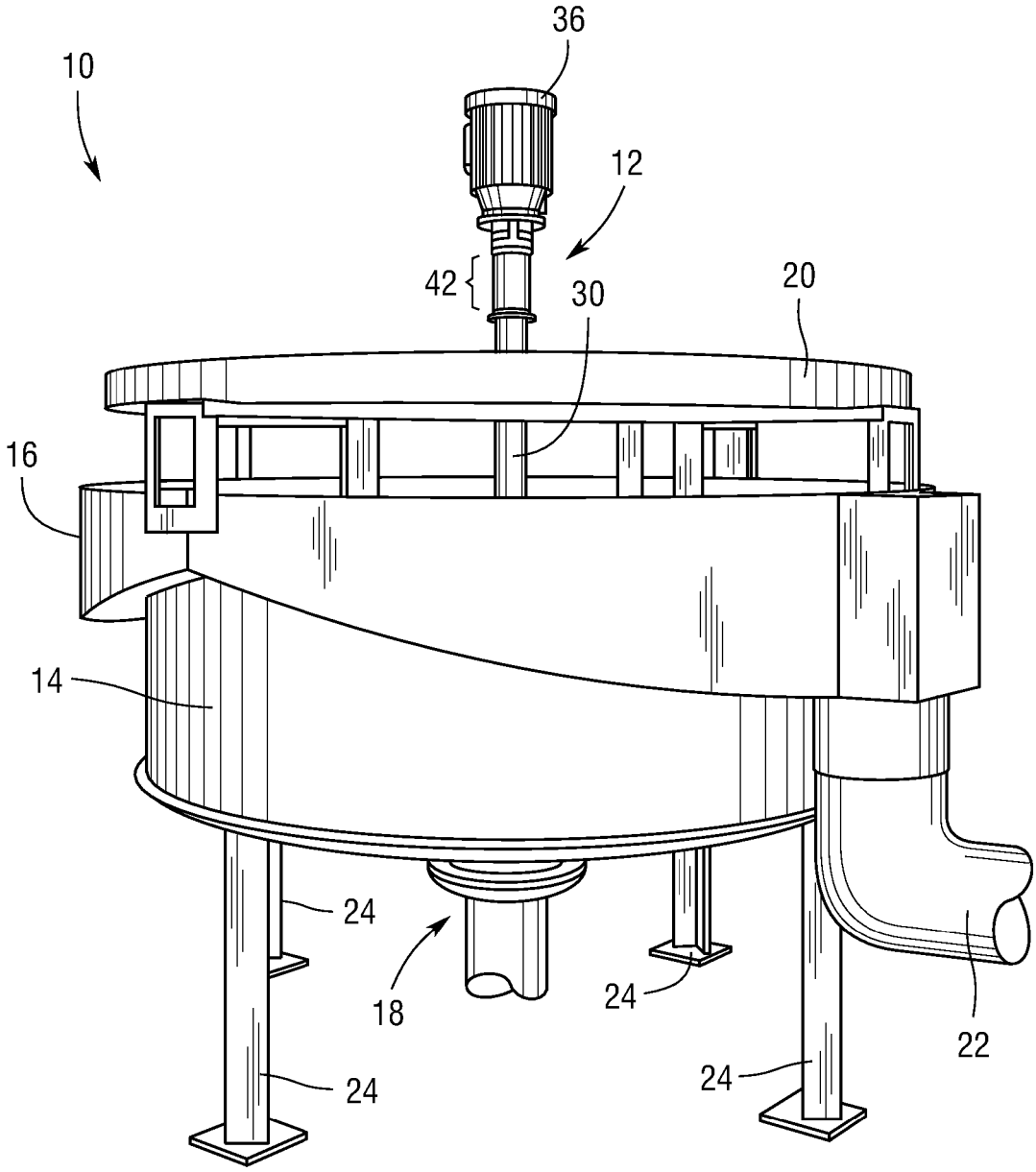
FIG. 1 is a perspective view of a flotation separation cell with one sparger unit.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

Flotation separation is commonly used in the minerals industry to separate mineral species in suspension in liquid slurries. Such mineral species are often suspended with a mixture of unwanted constituent species. Flotation separators currently in common use require an extensive application of large amounts of energy for pressurizing gas, pressuring the slurry, increasing the flow velocity of the slurry, and/or maintaining the slurry in suspension.

However, effective flotation separation is possible with the embodiments depicted herein without the need for high energy consumption. In one embodiment, shown in FIG. 1, a flotation separation system comprises at least one flotation separation cell 10 in a hydraulic system for the partitioning and recovery of the constituents of a slurry. The flotation separation cell 10 comprises at least one sparger unit 12 in which gas is introduced into the slurry. The sparger unit 12 includes a sparging mechanism 42 for sparging gas into a bubble dispersion within the slurry. The sparging mechanism 42 is configured such that slurry flow through it is substantially unrestricted. The effective open area in the sparging mechanism 42 is substantially the same as the effective open area in the sparger unit 12 upstream and downstream of the sparging mechanism 42. This ensures a low pressure drop across the sparging mechanism 42 that allows for a lower pressure and flow rate of slurry through the sparger unit 12 and represents a significant energy savings for the flotation separation system. The pressure drop across the sparging mechanism 42 is about 10 psig or less. The operation of various embodiments of sparger units 12 is described in further detail below.

The sparger unit 12 feeds the slurry and bubble dispersion mixture to a separation tank 14. The separation tank 14 comprises an overflow launder 16, an underflow removal port 18, and a froth washing system 20. The overflow launder connects to an overflow drain 22. The flotation separation cell 10 may be supported by legs 24 or by any other means required by the particular application. The flotation separation cell 10 may even be placed directly on the floor if warranted by the design of the facility to which the flotation separation cell 10 is installed. The separation tank 14 requires no additional equipment within the tank to assist in froth formation (as discussed in more detail below) or to maintain the slurry in suspension. This represents a further energy savings in the overall operation as compared to conventional flotation separation systems, column flotation separation systems, and packed column flotation separation systems. The operation of the flotation separation system is presented in more detail below.

The flotation slurries typically include hydrophobic and hydrophilic species. Flotation separation takes advantage of the differing hydrophobicity of these species. When bubbles of gas are introduced into the slurry, the hydrophobic species within the slurry tend to selectively adhere to the bubbles while hydrophilic species tend to remain in suspension. Sparging, or breaking up, the bubbles into a bubble dispersion of many smaller bubbles increases the available bubble surface area for hydrophobic species adhesion. The bubbles, with the adhered hydrophobic species, tend to rise above the slurry and form a froth in the separation tank 14 that is easily separated from the remainder of the slurry for further processing to recover the adhered hydrophobic species. In the embodiment shown in FIG. 1 removal of the froth is accomplished by overflowing the froth from the separation tank 14 into the overflow launder 16 and draining the collected froth through the overflow drain 22 to downstream processes. The species not adhered to the froth remain in the slurry and are discharged through the underflow removal port 18 for further processing. Further processing can include a subsequent stage of froth formation to catch hydrophobic species that for whatever reason were not captured in the preceding step.

Flotation separation systems are typically part of larger hydraulic systems that process slurry over a number of steps. The liquid portion of the slurry is typically water. The chemistry of the slurry is often adjusted with additives to assist in recovering a target component depending on the constituent species of the slurry. Surface tension modifying reagents, also known as frothers, are often added to slurries to assist in bubble formation. There are many types of frothers, including alcohols, glycols, Methylisobutyl Carbinol (MIBC), and various blends.

Sometimes the target species for recovery from the slurry are naturally hydrophobic, for example coal. But in slurries in which the target species are not hydrophobic, chemicals additives, also known as collectors, are introduced to chemically activate them. Collectors include fuel oil, fatty acids, xanthates, various amines, etc.

Some target species are quasi-hydrophobic. For example, oxidized coal tends to be less hydrophobic and is more difficult to recover from a slurry than unoxidized coal. Chemical additives, called extenders, are used to increase their hydrophobicity. Examples of extenders are diesel fuels and other fuel oils.

Chemical additives called depressants are used to reduce the hydrophobicity of a species. For example, in the recovery of iron ore, various types of starches are used to depress the bubble adhesion response of iron ore so that only silica can be floated in the froth from the slurry. If the depressants are not added, a portion of the iron ore will also adhere to bubbles and float within the froth.

Because the pH of the slurry can affect froth formation, other chemical additives are introduced to modify the pH of the slurry. Acids or bases are added as needed to adjust the pH depending on the composition of the slurry.

In mineral flotation, the recovery of a particular species is predominantly controlled and proportional to two parameters: reaction rate and retention time. Recovery can be generally represented by the following equation:

$$R=kT \quad [1]$$

Where R is the recovery of a particular species, k is the reaction rate of adhesion of a species to a bubble, and T is the retention time of the slurry in the flotation separation system. An increase in either parameter provides a corresponding increase in recovery, R. The reaction rate, k, for a process is indicative of the speed at which the flotation separation will proceed and can be a function of several parameters including, but not limited to, gas introduction rate, bubble size, species size, and chemistry. The reaction rate, k, is increased when these parameters are adjusted to maximize the probability that a hydrophobic species will collide with and adhere to a bubble and to reduce the probability that a hydrophobic species will detach from a bubble. The probability of attachment is controlled by the surface chemistry of both the species and the bubbles in the process stream and is increased when the probability of a collision between a hydrophobic species and a bubble increases. The probability of collision is directly proportional to the concentration of hydrophobic species within the sparging region. The probability of detachment is controlled by the hydrodynamics of the flotation separation cell. As such, aeration of the slurry prior to its introduction to a separation tank is the preferred method of sparging as this ensures that the maximum amount of floatable species is concentrated within the sparging unit to obtain a high recovery of the hydrophobic species. The embodiments described herein aim to increase the reaction rate, k, which means that a lower retention time, T, and thereby a smaller separation tank, can be used to obtain a suitable recovery, R.

In the embodiments disclosed herein, the reaction rate, k, of Equation [1] is increased by forcing the bubble-particle contact with high particle and air bubble concentrations and imparting significant energy within the bubble/particle contacting zone. Recovery, R, can also be represented in turbulent systems described herein as a function of the bubble concentration, $C_b$, particle concentration, $C_p$, and specific energy input, E, as follows:

$$R \propto C_b C_p E \quad [2]$$

The embodiments disclosed herein efficiently pre-aerate slurry in the sparger units 12 of the flotation separation cell 10 prior to injection of the slurry and gas mixture into the separation tank 14. Slurry introduced into the sparger unit 12 passes through a sparging mechanism 42, described in more detail below. The sparging mechanism 42 sparges the gas in the slurry into a bubble dispersion creating a relatively large surface area for hydrophobic species attachment within the sparger unit 12 such that hydrophobic species adhesion to bubbles occurs substantially in the sparger unit 12 before the slurry and the bubble dispersion is discharged into the separation tank 14. This approach ensures that bubbles are generated in the presence of the slurry prior to any dilution with wash water (if used), thus maintaining the maximum particle concentration ($C_p$). Additionally, the sparger assembly 30 is operated at a very high air fraction (>40%), insuring that the bubble concentration ($C_b$) is maximized. Finally, the design of the sparging mechanism 42 in the sparger unit 12 is such that maximum energy is imparted to the slurry for the sole purpose of bubble-particle contacting. As a result, the contact time is reduced by several orders of magnitude over prior art column and conventional flotation separators. After contacting, the slurry is discharged to the separation tank 14 for phase separation (slurry and froth) and froth washing (if used). Since phase separation is a relatively quick process, the overall separation tank 14 size is significantly reduced.

The sparging mechanism 42 is configured such that slurry flow through it is substantially unrestricted. The effective open area in the sparging mechanism 42 is substantially the same as the effective open area in the sparger unit 12 upstream and downstream of the sparging mechanism 42. This ensures a low pressure drop across the sparging mechanism 42 that allows for a lower pressure and flow rate of slurry through the sparger unit 12 and represents a significant energy savings for the flotation separation system. The pressure drop across the sparging mechanism 42 is about 10 psig or less. Nevertheless, the embodiments depicted herein are able to operate with pressure drops of about 1 psig or less.

As the bulk of the hydrophobic species adhesion to a bubble occurs in the sparging unit 12, the flotation separation cell 10 does not require the slurry to be introduced at a high velocity and/or a high pressure. The slurry may be pumped under pressure into the sparger unit 12 if the hydraulics of the flotation separation system require, but this need only be sufficient to provide enough hydraulic pressure for the slurry to flow through the flotation separation system. Slurry can be introduced into the flotation separation cell 10 at the slurry inlet of the sparger unit 12 at a hydraulic pressure of about 25 psig or less. The embodiments depicted herein are able to operate at slurry introduction hydraulic pressures of 2 psig or less.

The relatively low hydraulic pressure gradient that the slurry must overcome represents an energy savings during the operation of the flotation separation cell 10. The hydraulics of a flotation separation cell 10 can be adjusted in various embodiments by, for example, adjusting the height of the sparger units 12 in relation to the height of the slurry in the separation tank 14 or by adjusting the entry point of slurry to the flotation separation cell 10.

Similarly, the sparging mechanisms 42, described in more detail below, do not require gas to be introduced at a high pressure. The gas introduction pressure need only be high enough to form bubbles in the slurry and the sparging mechanisms 42 described herein will sparge the bubbles into effective bubble dispersions. The low pressure and flow requirements for both slurry and gas introduction represent significant energy savings when compared to conventional flotation separation systems, column flotation separation systems, and packed column flotation separation systems.

As has been already discussed, with an increase in the rate of reaction provided by the method of pre-aeration, there is a corresponding decrease in the required retention time for a given application. Therefore the same flotation recovery can be obtained in a smaller volume than with prior art systems. As the bubble and species attachment substantially occurs in close proximity to the sparging mechanism 42 in the sparger units 12, described in more detail below, and not within the separation tank 14 itself, the separation tank 14 is only required to provide time for the slurry and bubble phases to separate. A smaller separation tank 14 can be utilized without additional equipment in the separation tank when compared to conventional flotation separation systems, column flotation separation systems, and packed column flotation separation systems. The smaller and simpler flotation separation cell 10 allows for greater flexibility in designing flotation separation systems for particular applications. Energy is also not consumed to maintain the slurry in suspension in the separation tank 14.

Because the separation tank 14 is used solely for froth separation, and does not require any additional equipment to maintain the slurry in suspension, the embodiments described herein are able to maintain a relatively deep froth in the separation tank 14 with no additional turbulence imparted to the separation tank 14. Therefore, unlike with conventional flotation separation systems, the addition of wash water from the froth washing system 20 (described in more detail below) to clean the froth does not affect the retention time of the froth in the separation tank 14. It is therefore possible to have effective froth washing in the flotation separation systems described herein.

As the energy input to the system is focused specifically on creating fine bubbles and not in maintaining the particles in suspension, the overall energy input is reduced. While a compressor may be used to introduce gas into the flotation separation system, because the sparging mechanism 42 operates at atmospheric pressure a compressor is not required to overcome the hydrostatic system head. Instead, a simple blower can be used, providing energy and maintenance savings. The energy reduction, of course, implies reduced operating costs. Finally, the smaller separation tank 14 requirements reduce equipment and installation costs. Structural steel requirements are significantly less due to the reduction in tank weight and live load. The space requirement is less than that required for equivalent conventional column flotation separation. Shipping and installation is also simplified since the units can be shipped fully assembled and installed without field welding.

Figure 2:
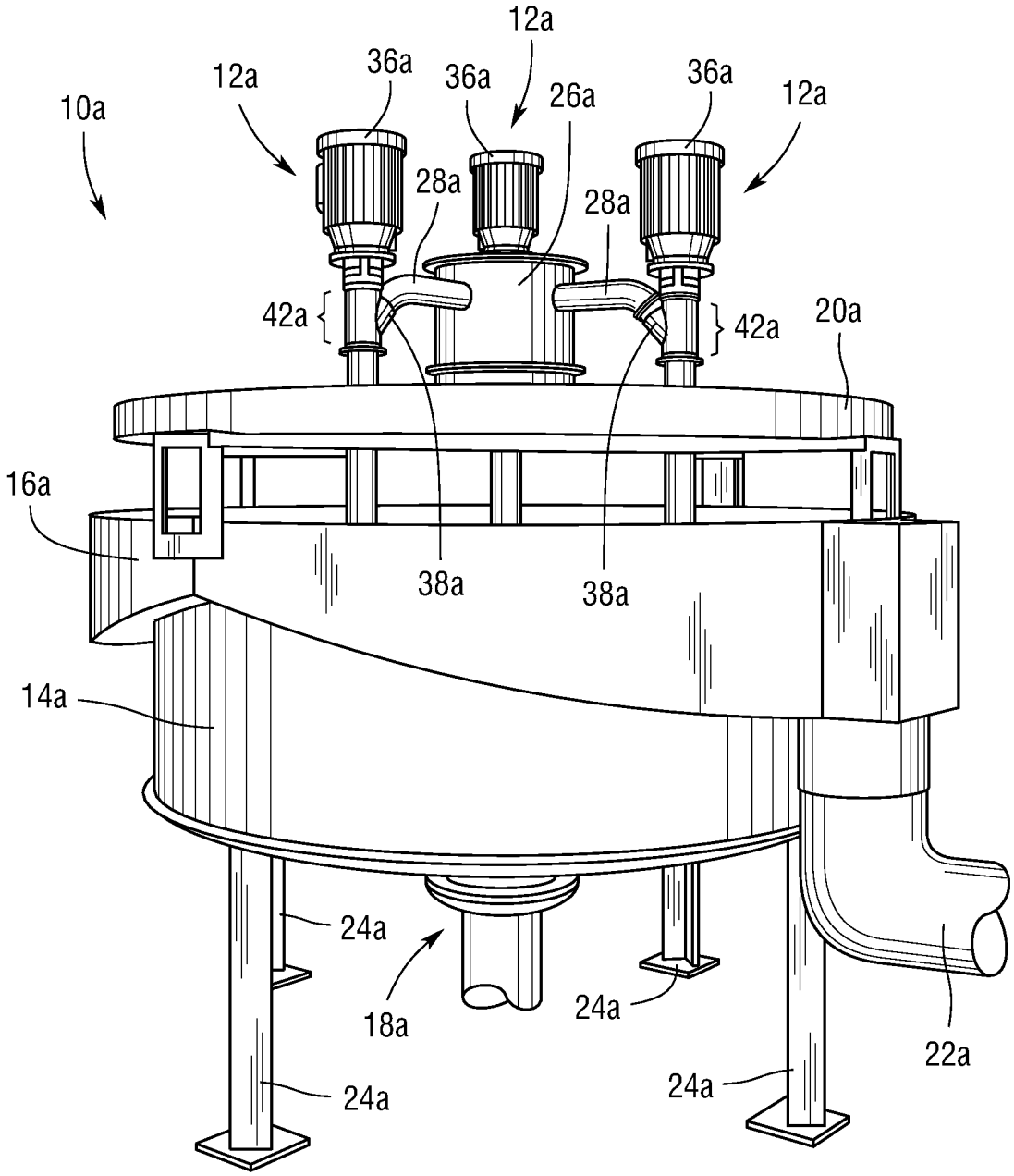
FIG. 2 is a perspective view of a flotation separation cell with three sparger units.

Depending on the operational requirements of the system to which the flotation separation system is installed, FIG. 2 shows how the flotation separation cell 10*a* can be designed with multiple sparger units 12*a*, in this case three, with an appropriately sized separation tank 14*a*. A feed manifold distributor 26*a* having distributor pipes 28*a* may be used to evenly distribute slurry to each sparger unit 12*a*.

Figure 3:
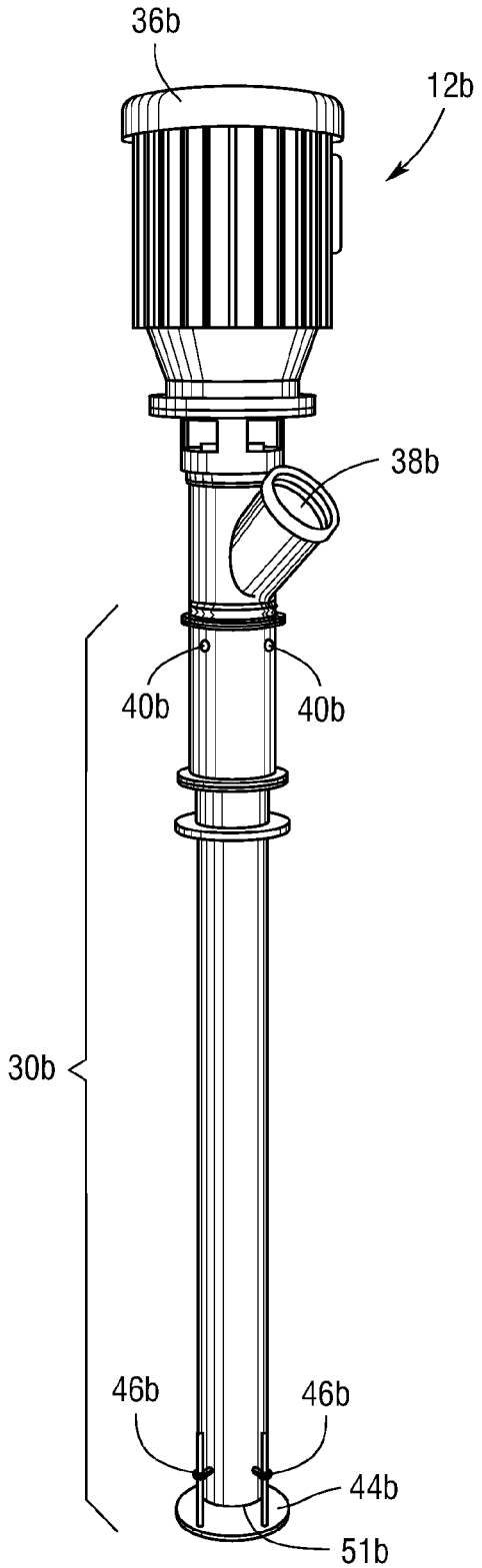
FIG. 3 is an embodiment of a sparger unit.
Figure 4:
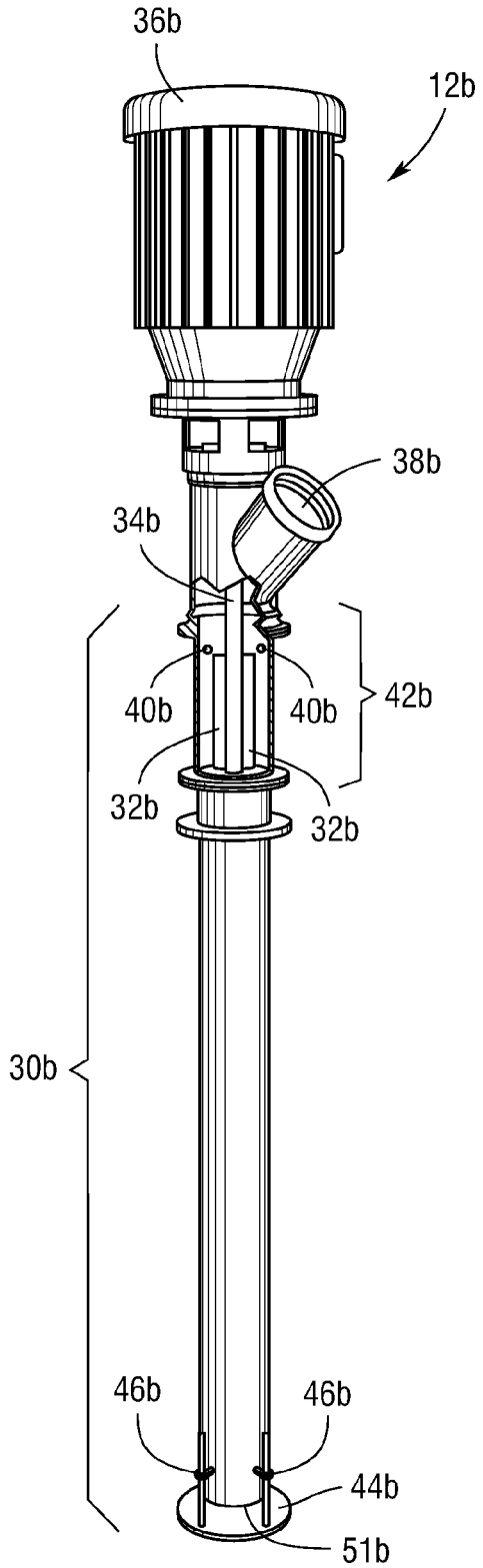
FIG. 4 is a view of an embodiment of a sparger unit showing the rotating high-shear element of the sparging mechanism.

In one embodiment of the sparger unit best understood by comparing FIGS. 3 and 4, each sparger unit 12*b* comprises a sparger assembly 30*b* that allows for the passage of feed slurry to a separation tank (14 and 14*a* in FIGS. 1 and 2). The size of the sparger assembly 30*b* is dictated by the size of the flotation separation system in which the sparger unit 12*b* is installed and is primarily intended to direct the slurry discharge to an appropriate location within the separation tank 14. The slurry should be discharged low enough in the separation tank 14 so as to not interfere with froth formation at the top of the separation tank 14.

Slurry is introduced into the sparger unit 12*b* through the slurry inlet 38*b* and passes through a sparging mechanism 42*b*. As has been already discussed, the sparging mechanism 42*b* is configured such that slurry flow through it is substantially unrestricted. The effective open area in the sparging mechanism 42*b* is substantially the same as the effective open area in the sparger unit 12*b* upstream and downstream of the sparging mechanism 42*b*. The pressure drop across the sparging mechanism 42*b* is about 10 psig or less.

In the embodiments depicted in FIGS. 3 and 4, the sparging mechanism 42*b* comprises a rotating high-shear element 32*b* attached to a rotating shaft 34*b* that is powered by an electric motor 36*b*. The slurry may be gravity fed if there is enough hydraulic pressure to ensure that the slurry will flow through the flotation separation system. If the hydraulics of the system requires the slurry to be pumped, the slurry need only be pumped with sufficient pressure to ensure passage of the slurry through the flotation separation system. Nevertheless, the sparger unit 12*b* will function well over a broad range of slurry flow rates and pressures. Slurry can be introduced into the slurry inlet 38*b* of the sparger unit 12*b* at a hydraulic pressure of about 25 psig or less. The sparger unit 12*b* can operate at a slurry hydraulic pressure of about 2 psig or less.

Gas (typically air) is introduced to the sparger unit 12*b* through gas inlets 40*b* that are supplied from a gas injection system (discussed in more detail below). The passing slurry flow immediately shears the gas to form bubbles as the gas enters the sparger unit 12*b* through the gas inlets 40*b*. The gas need not be at a high pressure for effective bubble formation in the slurry. Even at high slurry feed rates, the gas flow and pressure needs only be high enough to allow bubble formation in the slurry.

The bubbles are sheared into smaller bubbles as the slurry passes through the sparging mechanism 42*b* and forms a fine bubble dispersion within the slurry. The formation of the bubble dispersion within the sparger unit 12*b* exposes a larger volume of slurry to the surface of the bubbles. This increases the incidences of hydrophobic species collision with the bubbles and increases the probability of adhesion of a hydrophobic species to a bubble. In the embodiment depicted in FIGS. 3 and 4, this gas shearing is aided with the rotating high-shear element 32*b*. The rotating high-shear element 32*b* is intended to shear gas bubbles only and is not intended to agitate or mix the entire slurry volume, therefore, the electric motor 36*b* need only be large enough to drive the rotating high-shear element 32*b*. This represents a significant energy savings over flotation separation systems that require agitation of the slurry for bubble shearing.

The creation of the bubble dispersion with the sparger unit 12*b* exposes the entire volume of slurry to the surface of a bubble. Therefore the bulk of the adhesion of a hydrophobic species to a bubble is likely to occur within the sparger assembly 30*b*, in and downstream of the sparging mechanism 42*b*.

Once the slurry has passed though sparging mechanism 42*b*, the slurry and the bubble dispersion is discharged into a separation tank (14 and 14*a* in FIGS. 1 and 2) through a slurry outlet 51*b*. The velocity of slurry discharge is adjusted by changing the location of the distributor plate 44*b* using adjustment bolts 46*b*.

Figure 5:
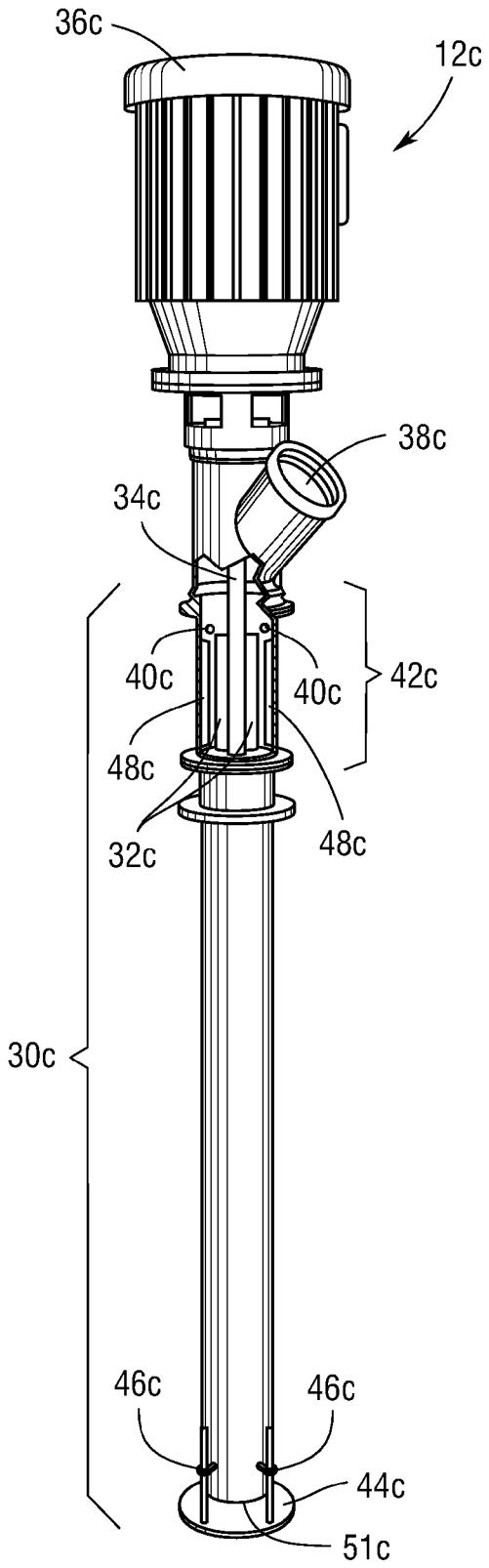
FIG. 5 is a view of an embodiment of a sparger unit showing the rotating and static high-shear elements of the sparging mechanism.

As shown in the embodiment depicted in FIG. 5, the sparger assembly 30*c* can contain opposing static vanes 48*c* to increase the shearing of gas bubbles in the sparging mechanism 42*c*. It will be appreciated that the rotating high-shear elements 32*b* and 32*c*, as shown in FIGS. 4 and 5, and the static vanes 48*c* shown only in FIG. 5 are for example purposes only and that other configurations of rotating high-shear elements and static vanes are possible and intended to be covered herein.

Figure 6A:
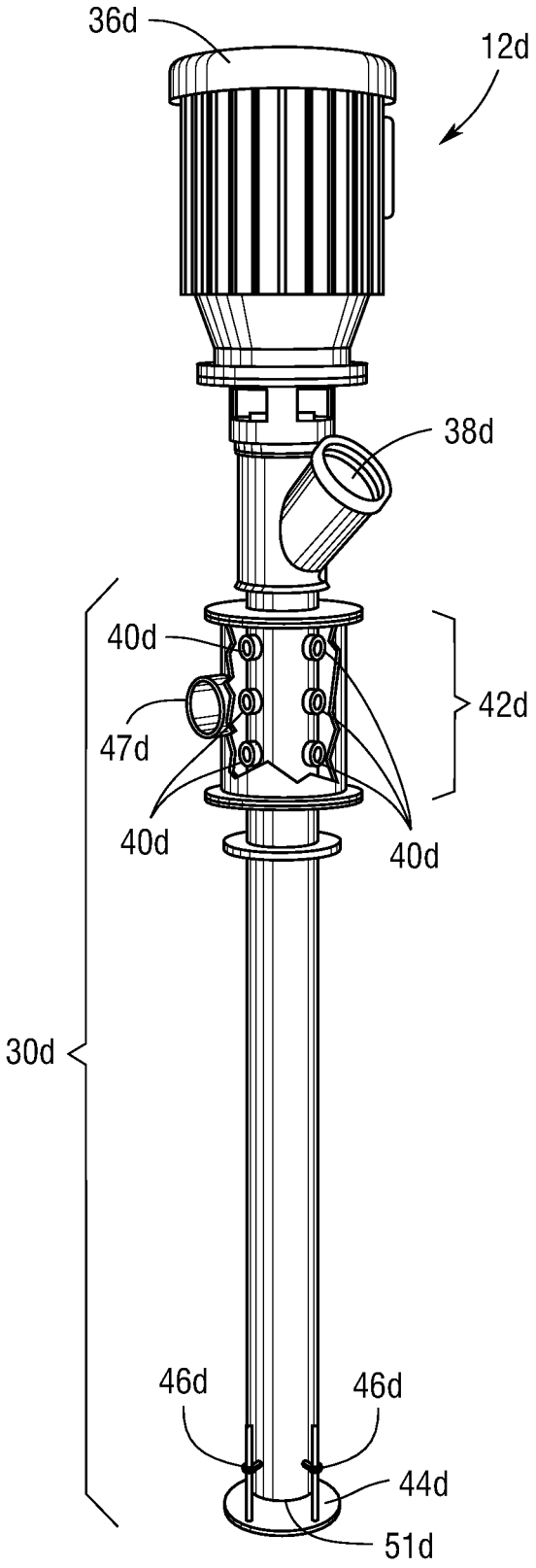
FIG. 6A is a view of an embodiment of a sparger unit in which the sparging mechanism has gas inlets along its length.
Figure 6B:
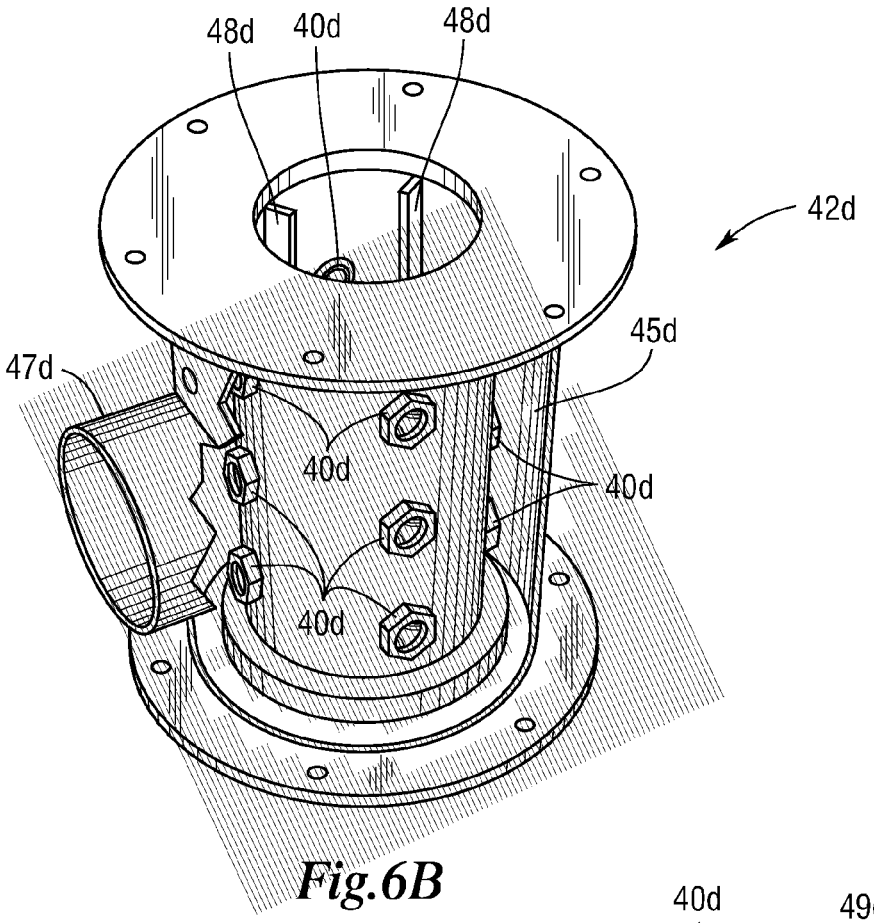
FIG. 6B is a view of the sparging mechanism of the sparger unit of FIG. 6A.
Figure 6C:
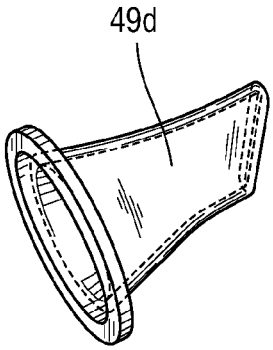
FIG. 6C is a close up of a check valve of a gas inlet of FIG. 6A.
Figure 6D:
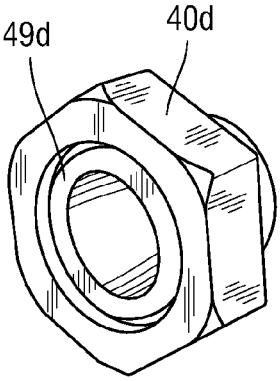
FIG. 6D is a gas inlet of FIG. 6A.
Figure 6E:
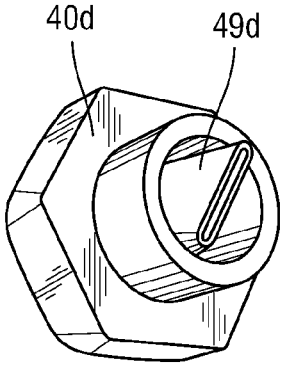
FIG. 6E is a different view of the gas inlet of FIG. 6D.

In the embodiments shown in FIGS. 4 and 5, the gas inlets 40*b* and 40*c* are situated upstream of the sparging mechanisms 42*b* and 42*c*. However, the embodiment of sparging mechanism 42*d* depicted in FIGS. 6A and 6B has gas inlets 40*d* over the length of the sparging mechanism 42*d*. The gas inlets 40*d* are supplied by gas from an outer sleeve 45*d* that connects to the gas injection system (discussed in more detail below) through a hose connection 47*d*. The gas inlets 40*d* are shown in more detail in FIGS. 6C through 6E and comprise an elastomeric check valve 49*d* that prevents the backflow of slurry into the outer sleeve 45*d*.

The rotating high shear elements 32*b* and 32*c* and the static vanes 48*c* in the sparging mechanisms 42*b* and 42*c* serve to break up the bubbles formed at the gas inlets 40*b* and 40*c* into smaller bubbles to increase the cumulative surface area. Variations of air sparging units are possible in which the gas is introduced to the slurry through the sparging mechanisms such that the bubbles formed are of an appropriate size to form a bubble dispersion.

As can best be understood by comparing the alternate arrangement in FIGS. 7A through 7E, the top of the sparger unit 12*e* comprises a gas supply coupling 50*e* to the gas injection system (discussed in more detail below). Gas is supplied through a gas supply tube 52*e* to the sparging mechanism 42*e*. The bottom of the supply tube 52*e* ends in a series of slots 56*e* that define the length of the sparging mechanism 42*e*. In this embodiment, the sparging mechanism 42*e* comprises a series of discs 58*e* that are stacked up to at least the length of the slots 56*e* in the gas supply tube 52*e*. Each disc 58*e* has a series of grooves 60*e* that run from the slots 56*e* in the gas supply tube 52*e* to the outer edge of the disc 58*e*. When the discs 58*e* are stacked on top of each other, the grooves 60*e* define channels for the gas to mix with the passing slurry. In this embodiment each groove 60*e* acts as a gas inlet for the sparger unit 12*e*. The number and size of the grooves 60*e* and the thickness and the number of the discs 58*e* are determined by the particular application. The smaller the grooves 60*e*, the smaller the bubbles formed when the passing flow of slurry sparges the gas. The smaller gas bubbles created by the sparging mechanism 42*e* in this embodiment are of an appropriate size to form a bubble dispersion. Therefore the grooves 60*e* also serve as the high shear element of this embodiment of sparger unit 12*e*. This sparger unit 12*e* requires even less energy to operate than the embodiments presented earlier.

Nevertheless, the sparging mechanism 42*e* is configured such that slurry flow through it is substantially unrestricted. The effective open area in the sparging mechanism 42*e* is substantially the same as the effective open area in the sparger unit 12*e* upstream and downstream of the sparging mechanism 42*e*. The pressure drop across the sparging mechanism 42*e* is about 10 psig or less.

The sparger units 12*e* can be easily disconnected from the gas injection system (discussed in more detail below) and water, gas, or another cleaning agent can be forced through the grooves 60*e* to facilitate cleaning of the sparging mechanism 42*e*. The discs 58*e* may be made from metal, plastic, polyurethane, ceramics, or any other material that would be appropriate for the particular application. While the discs 58*e* depicted in FIGS. 7A though 7E have grooves 60*e* on only one side, FIG. 8 shows a disc 58*f* having grooves 60*f* on both sides.

Figure 7A:
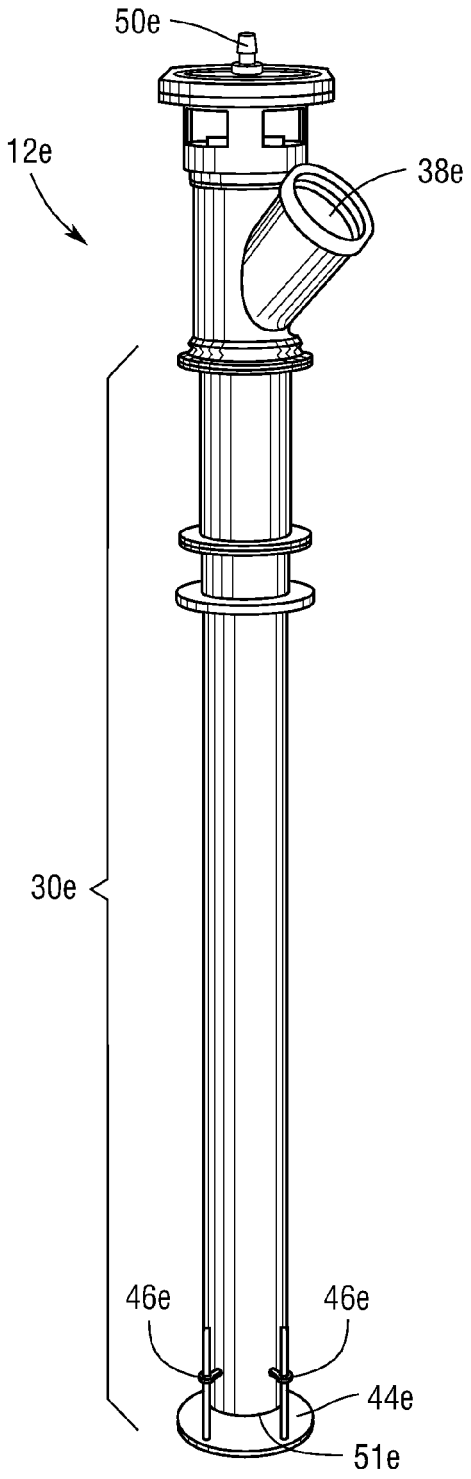
FIG. 7A is an embodiment of a sparger unit that does not use an electric motor.
Figure 7B:
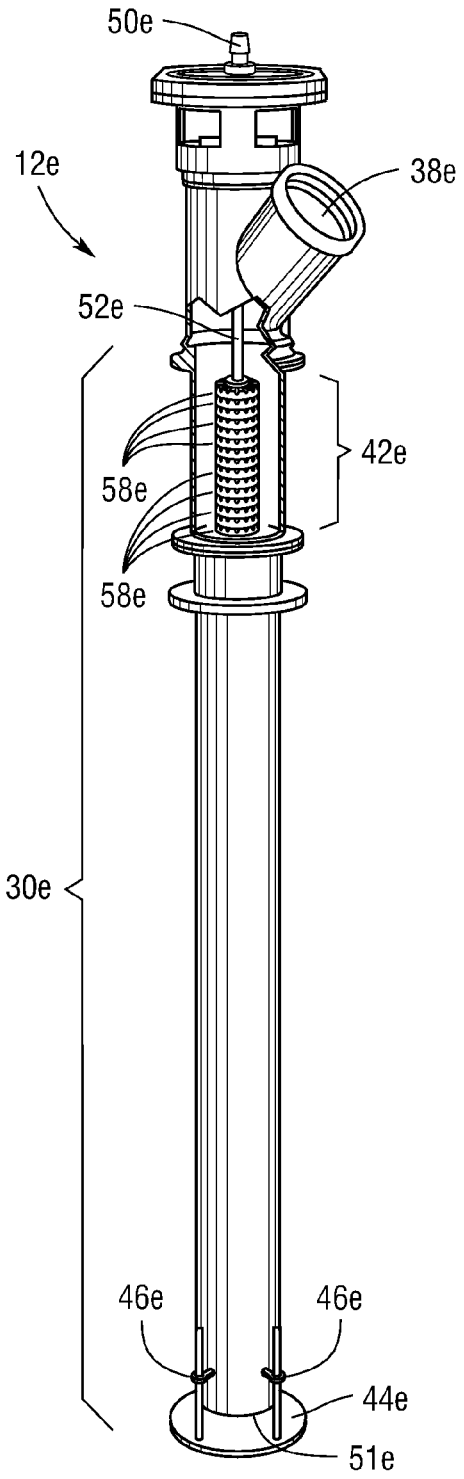
FIG. 7B is a view of the sparger unit of FIG. 7A showing the sparging mechanism with the high shear element comprising a series of grooved discs.
Figure 7C:
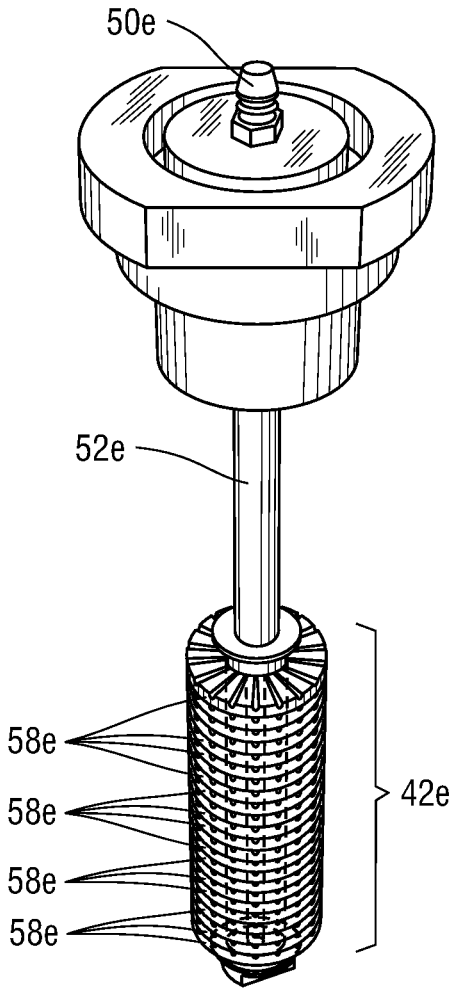
FIG. 7C is a view of the high shear element of FIG. 7B.
Figure 7D:
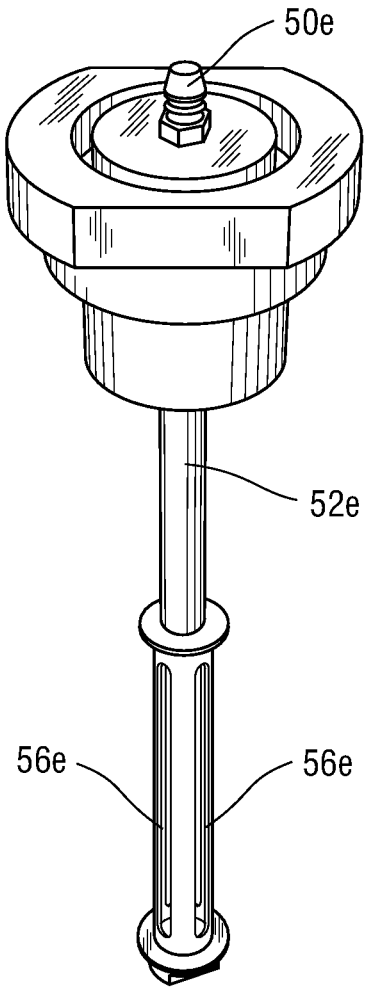
FIG. 7D is a view of the high shear element of FIG. 7B without the grooved discs.
Figure 7E:
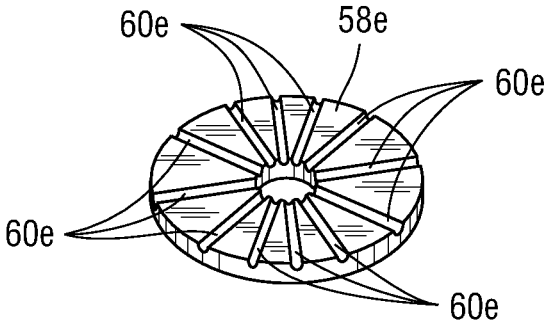
FIG. 7E is a view of a grooved disc of FIG. 7B.
Figure 8:
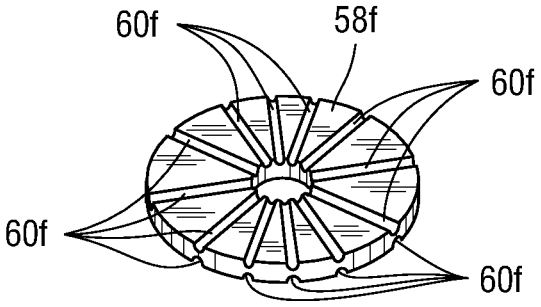
FIG. 8 is a view of an alternative embodiment of the grooved discs of FIG. 7B.
Figure 9A:
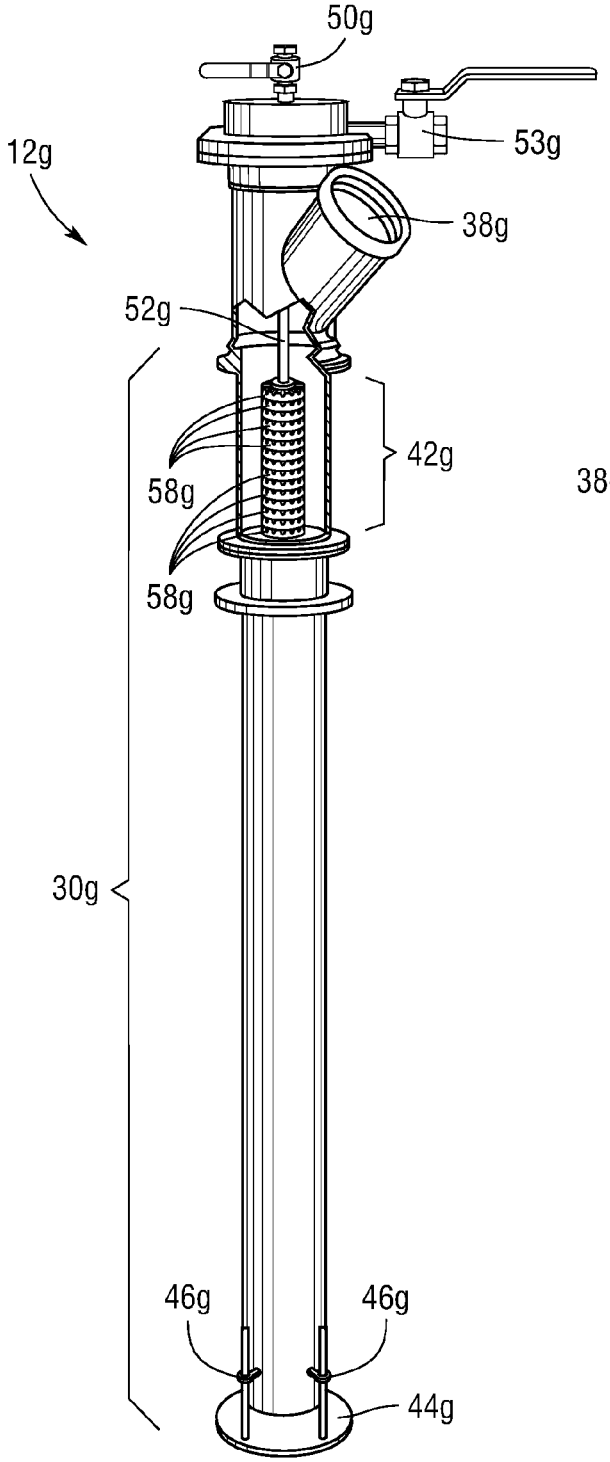
FIG. 9A is an embodiment of a sparger unit with a cleaning system for the sparging unit.
Figure 9B:
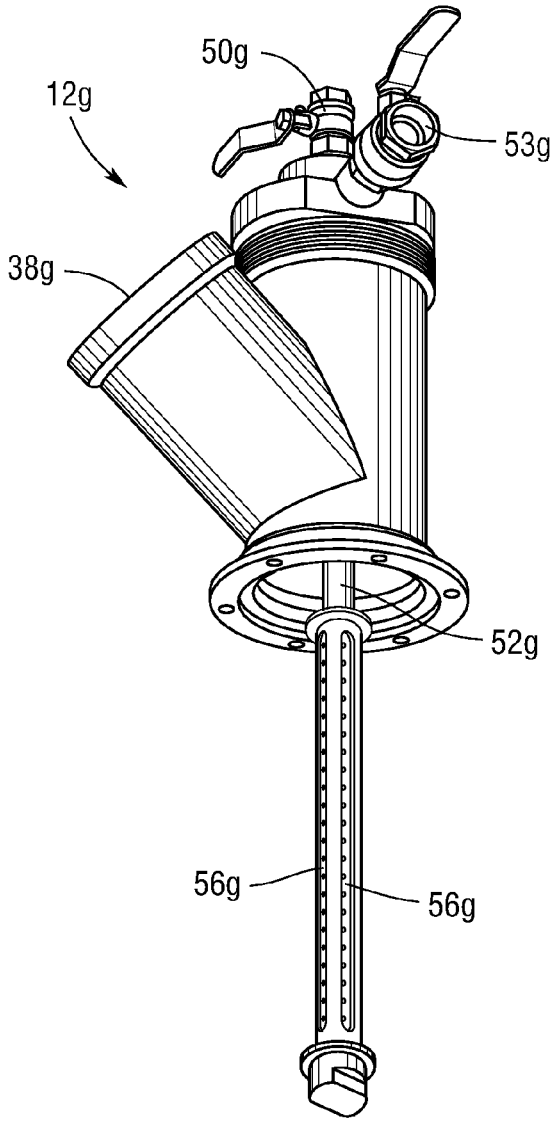
FIG. 9B is a close up of the sparger unit of FIG. 9A without the grooved discs.
Figure 9C:
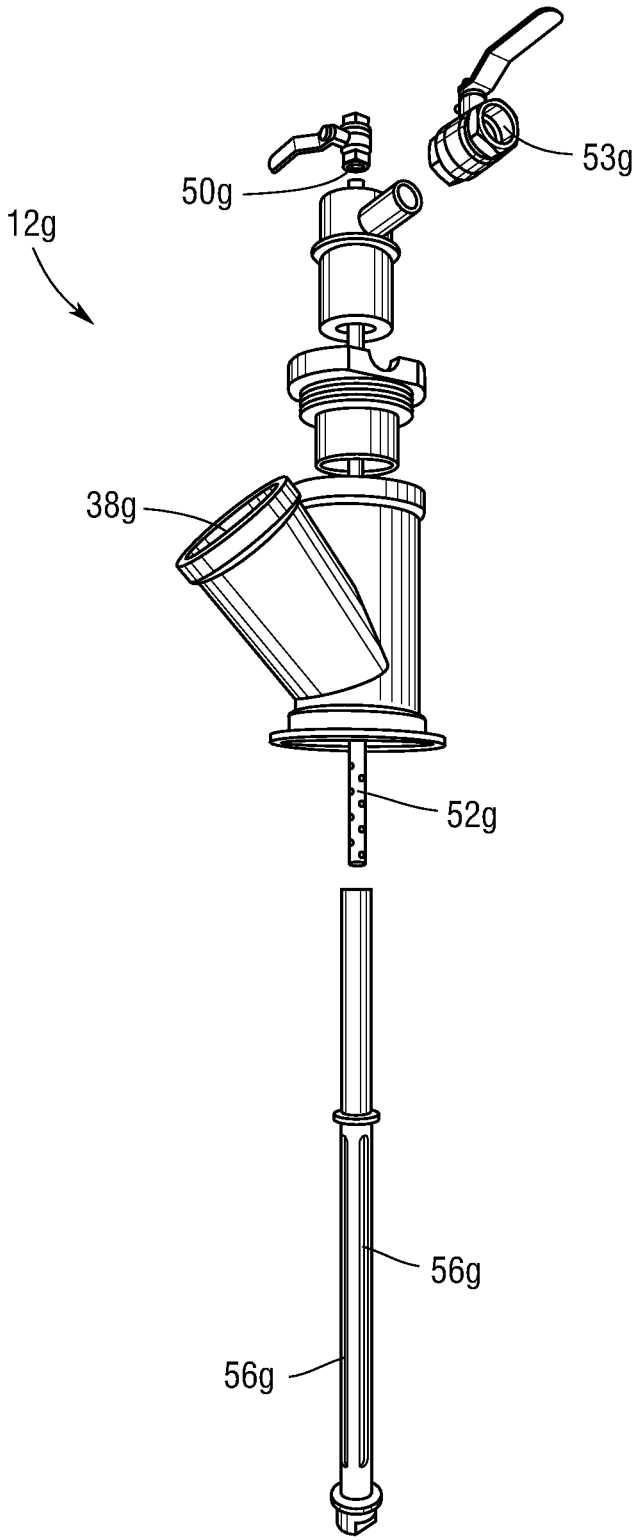
FIG. 9C is an exploded view of the sparger unit of FIG. 9A.

The sparger units 12*g* shown in FIGS. 9A through 9C are a variation of the sparger unit 12*e* of FIG. 7A. This embodiment incorporates a cleaning mechanism for the sparging mechanisms 42*g*. As can be best understood by comparing FIGS. 9A through 9C, the sparger unit 12*g* includes an inner gas supply tube 52*g* connected by a gas supply coupling 50*g* to the gas injection system (discussed in more detail below). A cleaning fluid coupling 53*g* allows for the introduction of a cleaning fluid into the sparger unit 12*g*. The fluid could be water, compressed gas, or other fluid that could be fed at high pressure to clear debris or clean out the grooves on the discs 58*g* during routine maintenance or as needed.

Figure 10:
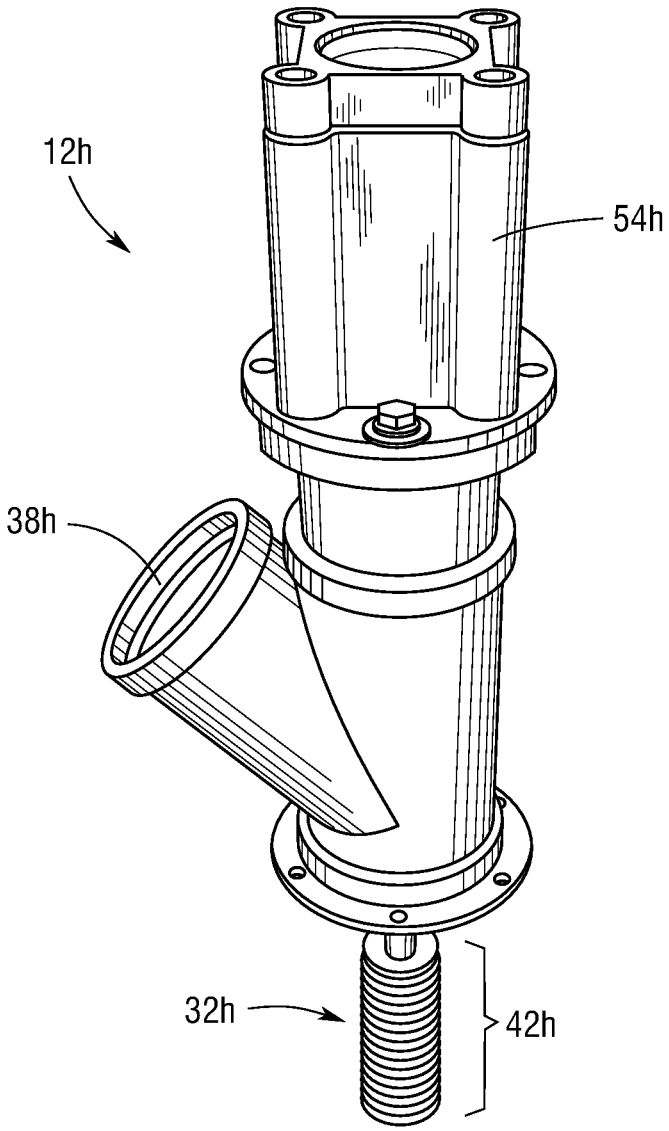
FIG. 10 is a sparger unit in which the sparging mechanism is a high frequency linear displacement device.

The embodiment of sparger unit 12*h* shown in FIG. 10 shows the sparging mechanism 42*h* comprising a high frequency displacement device 54*h*. In this embodiment gas is introduced to the sparger unit 12*h* similar to the embodiment shown earlier, but other gas injection mechanisms are possible. The high frequency displacement device 54*h* generates a high frequency vibration at the high shear element 32*h* that sparges bubbles formed by the gas inlets (not shown) as the bubbles pass the sparging mechanism 42*h*. This vibration shears the bubbles to create the fine bubble dispersion in the slurry. Nevertheless, the sparging mechanism 42*h* is configured such that slurry flow through it is substantially unrestricted. The effective open area in the sparging mechanism 42*h* is substantially the same as the effective open area in the sparger unit 12*h* upstream and downstream of the sparging mechanism 42*h*. The pressure drop across the sparging mechanism 42*h* is about 10 psig or less.

Figure 11:
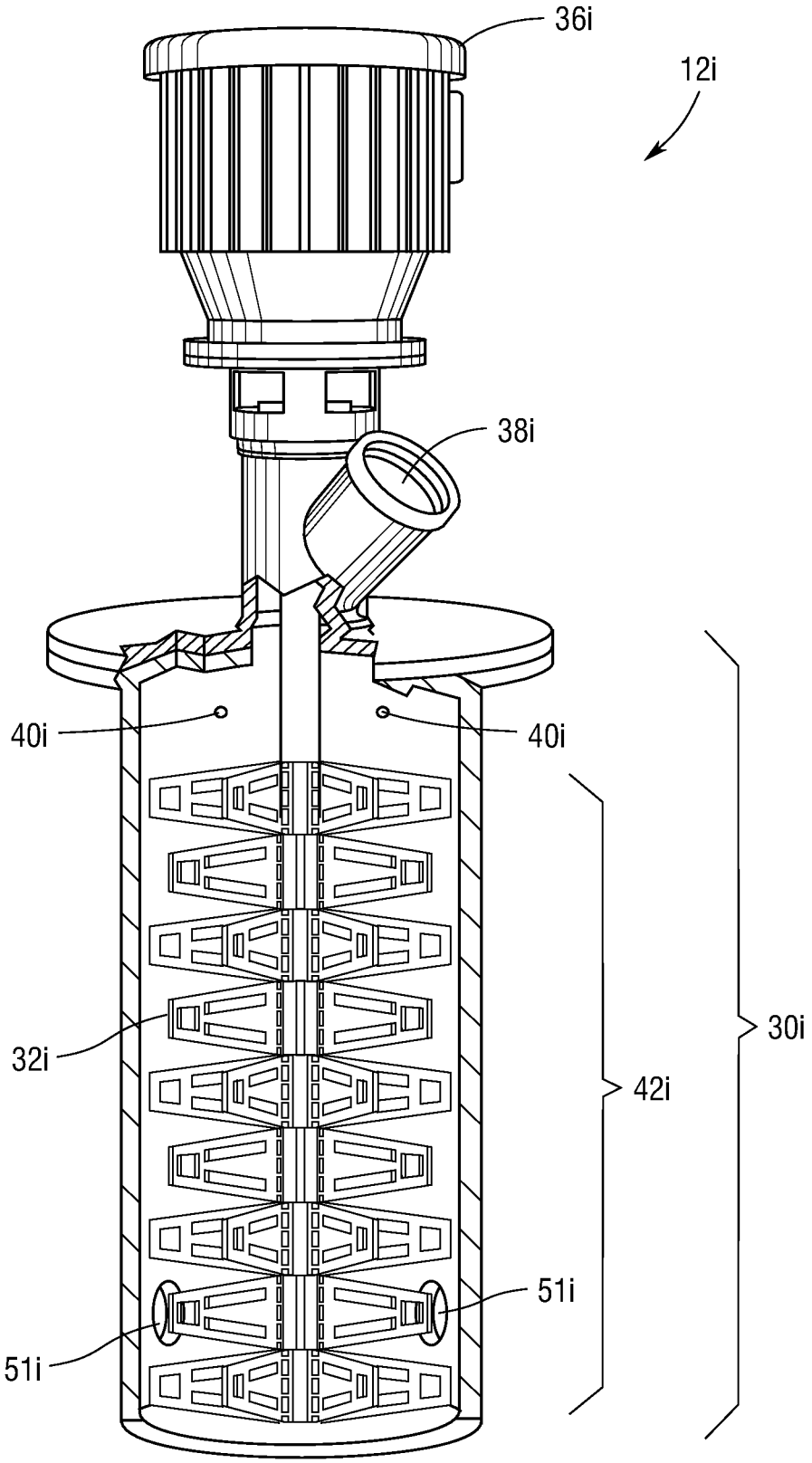
FIG. 11 is a view of an embodiment of a sparger unit showing a sparger mechanism having multiple banks of rotating high shear elements.

As shown in FIG. 11, other embodiments of sparger units 12*i* are possible in which the sparging mechanism 42*i* extends across the length of the sparger assembly 30*i*. These embodiments function similarly to the sparger unit 12*b* shown and described in FIG. 4 above, however any of the other embodiments described above would work equally well. The sparging mechanism 42*i* shown in FIG. 11 comprises a series of rotating high shear elements 32*i* that serve to further break up and shear introduced gas into fine bubbles. In this embodiment, the blades of the high shear elements 32*i* have openings cut into them to further shear the bubbles. The stacked rotating high shear elements 32*i* increase the amount of sparging each unit volume of slurry is exposed to as it moves through the sparger unit 12*i*. As with the embodiments discussed above, the energy input into the sparger unit 12*i* is for shearing introduced gas into a fine bubble dispersion and not for agitating the slurry. The sparger unit 12*i* could also incorporate static vanes as shown for example in FIG. 5 to increase the shearing of gas bubbles in the sparging mechanism. The embodiment shown in FIG. 11 shows the outlets 51*i* from the sparger unit 12*i* as holes cut into the side of the sparger assembly 30*i*.

Figure 12:
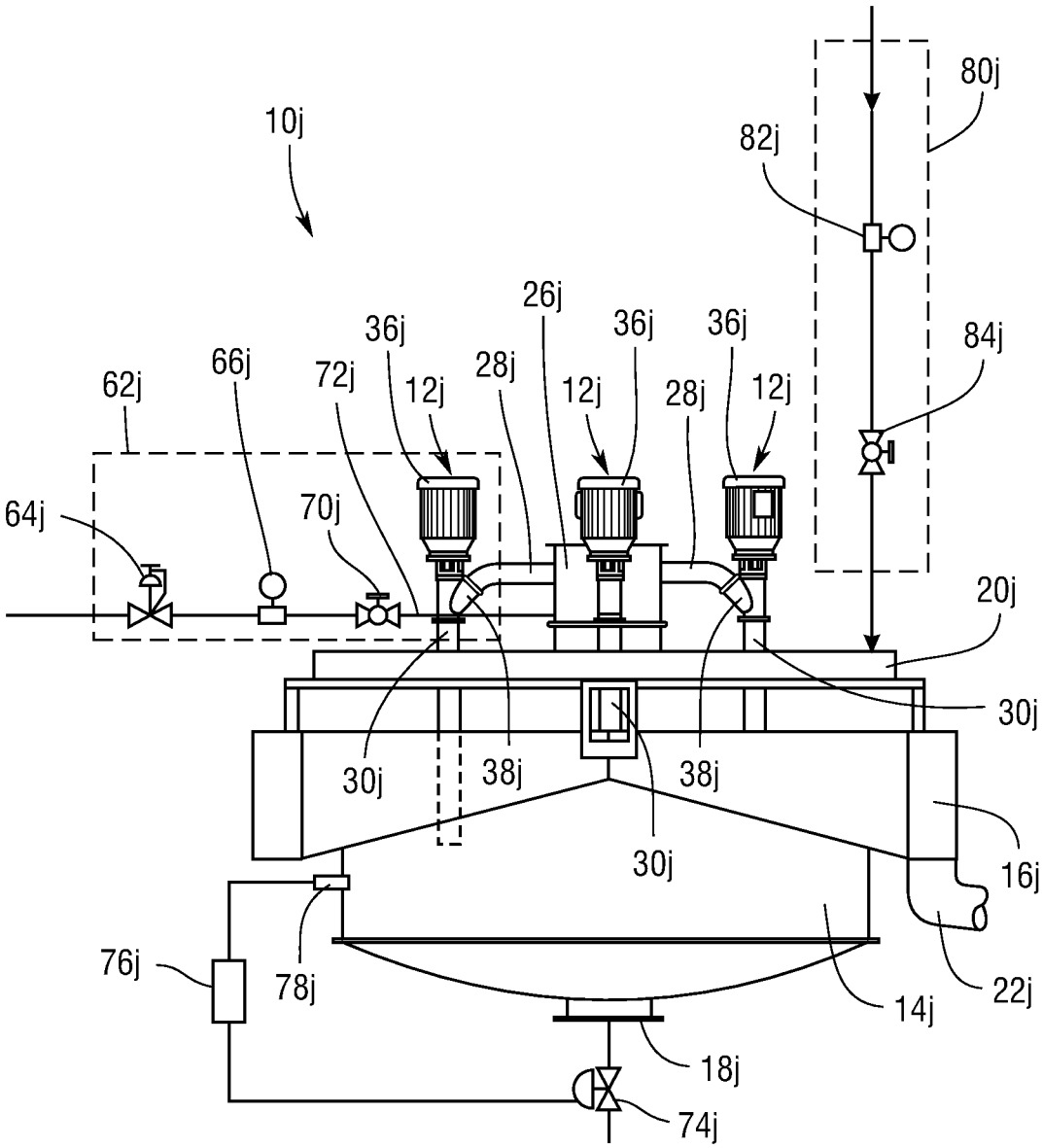
FIG. 12 is a representation of some of the control systems for a flotation separation cell.

Regardless of the embodiment of sparger unit 12*j* used, the operation of the flotation separation system is demonstrated in the flotation separation cell 10*j* depicted in FIG. 12. The flotation separation cell 10*j* shows three sparger units 12*j*, but the operation described is applicable to any number of sparger units 12*j*. A flotation separation cell having only one sparger unit (for example as shown in FIG. 1) would not require a feed manifold distributor as shown in FIG. 12.

Slurry is fed to the feed manifold distributor 26*j* from upstream operations in which the flotation separation cell 10*j* is installed. As has already been discussed, the slurry may be pumped under pressure into the sparger unit if the system hydraulics require, but this need only be sufficient to provide enough hydraulic pressure for the slurry to flow through the flotation separation cell 10*j*. Slurry can be introduced into the flotation separation cell 10*j* at the slurry inlet 38*j* of the sparger unit 12*j* at a hydraulic pressure of about 25 psig or less. The feed manifold distributor 26*j* evenly distributes slurry to the slurry inlets 38*j* of the sparger units 12*j* through distributor pipes 28*j*. The pressure drop across the sparging mechanisms of the sparger units 12*j* is about 10 psig or less.

Gas, typically air, is supplied to the sparger units 12*j* from the gas injection system 62*j*. As discussed earlier, gas introduction pressure need only be high enough to allow bubbles to form in the slurry. The gas injection system 62*j* consists of a pressure regulator 64*j*, a gas flow meter 66*j*, a flow regulating valve 70*j*, and a gas manifold distributor 72*j*. The gas manifold distributor 72*j* connects the gas injection system to the sparger units 12*j*. A low-pressure gas blower (not shown) would preferably supply gas to the gas injection system 62*j*. Alternatively, compressed gas tanks (not shown) or gas compressors (not shown) can be employed.

The operation of sparger units 12*j* is as previously described. The slurry and the bubble dispersion are discharged into the separation tank 14*j*, which allows for the separation of the floatable and non-floatable hydrophobic species. A froth of bubbles with adhered floatable hydrophobic species forms above the slurry at the top the separation tank 14*j*. The froth can be removed from the top of the separation tank for further processing. In one embodiment, the froth overflows the separation tank into a product launder 16*j*. The froth overflow is discharged from the product launder 16*j* through the overflow drain 22*j* for further processing.

Non-floatable hydrophobic species, heavier particles that do not adhere to the froth, and any hydrophobic species that for whatever reason do not adhere to the froth fall to the bottom of the separation tank 14*j* and are drained through the underflow removal port 18*j* for further processing. The rate of underflow discharge is controlled through a control valve 74*j* that is actuated based on a signal provided by a process controller 76*j*. The output of the process controller 76*j* is proportional to an input signal derived from a pressure sensor 78*j* located on the side of the separation tank 14*j*. Alternatively, various other level control systems can be employed such as pumps, sand gates, and overflow weir systems.

The froth at the top of the separation tank is washed with the froth washing system 20*j*. Water or any other cleaning liquid used for froth washing is controlled by the froth washing control system 80*j*. In the froth washing system 20*j*, clean water is evenly distributed across the top of the froth using a perforated wash pan. Alternatively, the froth washing system 20*j* can comprise rings of perforated pipe (not shown). The flow of wash water is controlled using a flow meter 82*j* and a flow control valve 84*j*.

A pilot scale flotation separation system similar to the flotation separation cell depicted in FIG. 1 is currently in operation. The pilot flotation separation cell comprises a separation tank that is 48 inches in diameter and about 60 inches deep and has a single sparger unit that is about 4 inches in diameter. The sparger unit processes coal slurry at the rate of about 600 gpm. The sparging mechanism is similar to the embodiment depicted in FIG. 4. The high shear element of the sparger unit rotates at about 1,200 rpm. Gas is introduced at the gas inlets at about 60 scfm. Slurry enters the sparging mechanism by gravity and has been measured at the sparging mechanism to have a hydraulic pressure of less than 1 psig. During normal operating conditions, slurry fills the separation tank up to 3 feet from the bottom with froth filling an additional 2 feet above the slurry. The froth is washed with clean water using clean water sprayed over the top of the froth through an arrangement of perforated pipes at a rate of up to 60 gpm.

The flotation response of several coal types were investigated including the Amburgy, Hazard No. 4, Red Ash, Gilbert and Pocahontas No. 3 seams. For the Amburgy and Hazard No. 4 seams (FIG. 5), the ash content of the flotation feed averaged 52%, by weight. Combustible recovery ranged from 30% to 78% depending on operating parameters. The average combustible recovery for a single-stage of treatment was approximately 60% with a product ash content of 6%. Similarly, an average combustible recovery of between 40% and 50% was achievable while treating Red Ash, Gilbert, or Pocahontas No. 3 coal seams. For these coals, the product ash averaged less than 4% by weight. The lower feed ash (i.e., 18%) for these seams resulted in a slightly lower range of combustible recovery. This finding is not unexpected given that as the feed ash decreases, the amount of floatable coal increases for a given volume flow and retention time.

Figure 13:
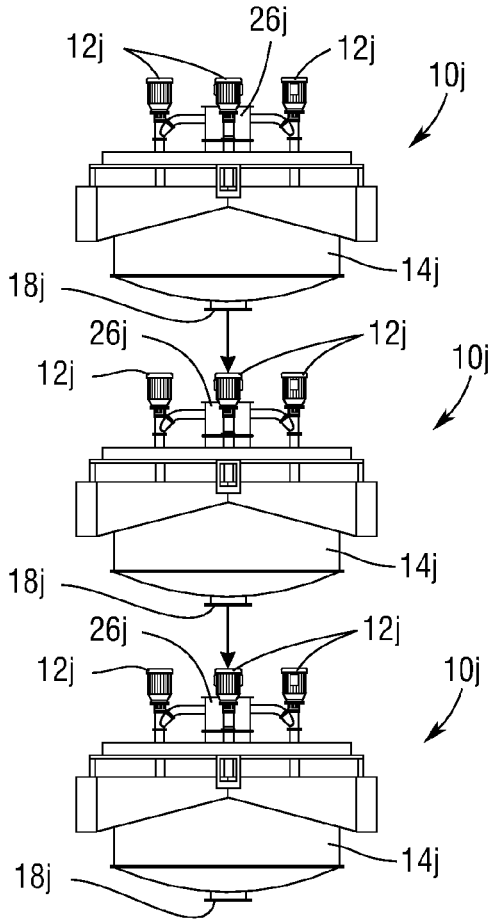
FIG. 13 shows a flotation separation system that comprises a series of flotation separation cells in a modular vertical arrangement.
Figure 14:
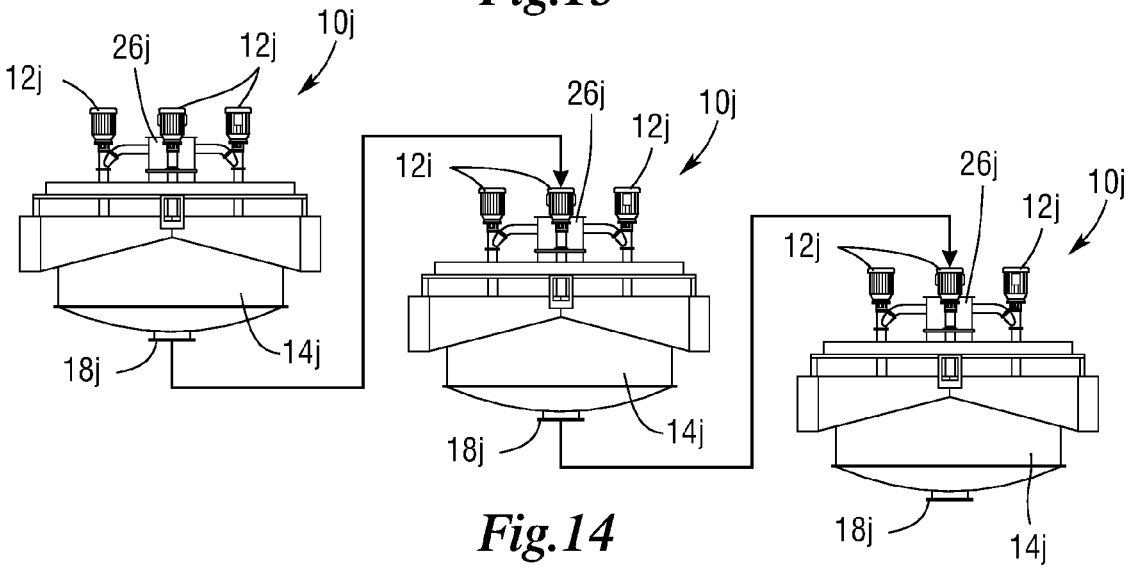
FIG. 14 shows a flotation separation system that comprises a series of flotation separation cells in a staggered horizontal arrangement.

While hydrophobic species adhesion to the bubble dispersion in the sparger units 12*j* allows for a high recovery of hydrophobic species in the slurry, not all of the hydrophobic species in the slurry will adhere to a bubble. Furthermore, there is a reduction in bubble surface area at the interface of the froth and the slurry in the separation tank 14*j* that leads some adhered hydrophobic species to fall off and be lost to the underflow nozzle 18*j*. As has been already discussed, the flotation separation system described herein requires a smaller separation tank size than conventional flotation separation systems. As shown in FIGS. 13 and 14, this allows for several flotation separation cells 10*j* to be easily combined in-series to negate the effects of mixing and hydrophobic species bypass of the bubble dispersion.

Figure 15:
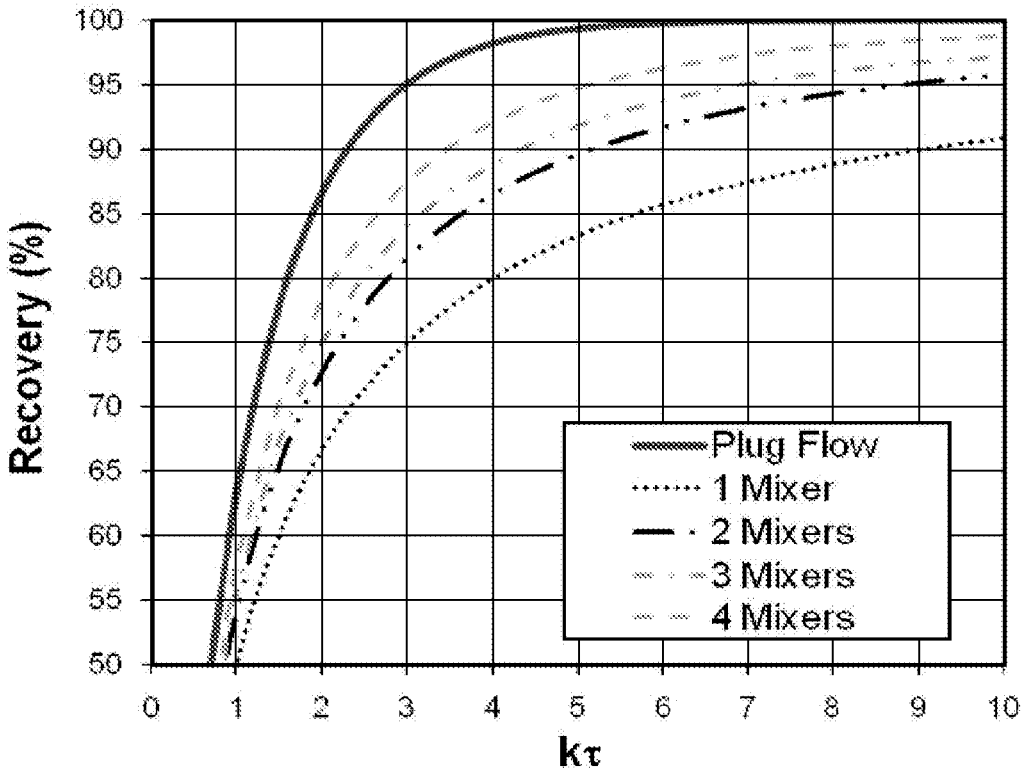
FIG. 15 is a graph plotting the recovery of a target species versus process rate and retention time for various circuit configurations.

The fundamental principle favoring a tank-in-series approach is simple and well known: for an equivalent retention time, a series of perfectly mixed tanks will provide a higher recovery than a single cell. This point is illustrated by the following equation:

$$R = 1 - \left(\frac{N}{N + k\tau}\right)^N \quad [3]$$

where the change in recovery, R, is a function of the number of perfect mixers (N) for a system with a constant process rate (k) and retention time (τ). As shown in FIG. 15, increasing the number of mixers in series, at a constant value of kτ, results in an increase in recovery. For example, for a kτ value of 4, changing from one perfectly mixed tank to four cells in series results in an increased recovery of nearly 15%.

This concept can be understood by examining the basic operation of a conventional flotation cell. Each cell contains a mixing element that is used to disperse air and maintain the solids in suspension. As a result, each cell behaves "almost" as a single perfectly mixed tank. By definition, a perfectly mixed tank has an equal concentration of material at any location in the system. Therefore, a portion of the feed material has an opportunity to immediately short circuit to the tailings discharge point. In a system using a single large cell, this would imply a loss in recovery. However, by discharging to a second tank, another opportunity exists to collect the floatable material. Likewise, this is also true with the third and fourth cell in the series. Of course, at some point, the law of diminishing returns applies. In conventional flotation systems, this is typically after four or five cells in series. However, the recovery gain with each cell requires additional energy.

Based on the same principle, the in-series arrangements shown for example in FIGS. 13 and 14 reduce the inadvertent bypass of feed slurry from individual flotation separation cells 10*j*. In such modular in-series arrangements, the slurry that leaves through the underflow nozzle 18*j* of one separation tank 14*j* is redirected to the sparger units 12*j* of the next flotation separation cell 10*j*. This arrangement increases the particulate recovery from a slurry stream. The flotation separation cells 10*j* can be placed in a modular vertical arrangement (as in FIG. 13), a staggered horizontal arrangement (as in FIG. 14), or any arrangement that allows for a sufficient hydraulic pressure to convey the slurry from cell to cell. If such a configuration is not possible in the particular application, the slurry could be pumped to each subsequent cell in the series. The number of required flotation separation cells 10*j* will be dependent on the specific application.

In any of the embodiments herein, it is also possible to divert a portion of the slurry discharge from the underflow removal port 18 or the overflow drain 22 back to the initial sparger unit 12 (or the feed manifold distributor 26*a* in flotation separation systems with more than one sparger unit 12*a*).

This would serve to recycle any chemical additives used to promote frothing and would reduce the materials cost of operation. Similarly, in the embodiments shown in FIGS. 13 and 14, a portion of the discharge from the underflow removal port 18*j* or the overflow drain (not shown) from the last flotation separation cell 10*j* can be diverted back to the feed manifold distributor 26*j* of the first flotation separation cell 10*j*.

The energy requirements of the flotation separation systems described herein are orders of magnitude lower than conventional flotation separation systems, column flotation separation systems, and packed column flotation separation systems for processing a similar amount of slurry with comparable recovery results. A conventional flotation separation system that processes 3,000 gpm of coal slurry may typically comprise 6-8 separation tanks in series, with each separation tank containing a 20-30 HP motor to turn impellers to mix the slurry in the tanks, for a total of about 200 HP for mechanical agitation. Such a conventional system would require an additional 150 HP to power the air blower system for sparging gas. A typical column flotation separation system that processes 3,000 gpm of coal slurry requires slurry recirculation pumps that could require around 200 HP to operate. An additional 200 HP would be required to operate the air compressors for sparging bubbles. A packed column flotation separation systems of similar 3,000 gpm capacity typically would have similar requirements to a typical column flotation system with about 200 HP for recirculation pumps and about 200 HP for air compressors.

In contrast, a flotation separation system as described herein for processing 3,000 gpm of coal slurry, comprising three flotation separation cells in series, each cell having a single sparger unit with sparging mechanisms that comprise a series of rotating high shear elements (similar to those shown in FIG. 11) would require significantly less energy. The energy required to power each sparger unit in such a system would be around 20 HP for a total of 60 HP for all three sparger units. The energy required by the gas supply system would be about 70 HP for all three sparger units. Each separation tank in such a configuration would be about 11 feet in diameter and about 6 feet deep. This represents a significant savings in energy consumption and material requirements.

Figure 16A:
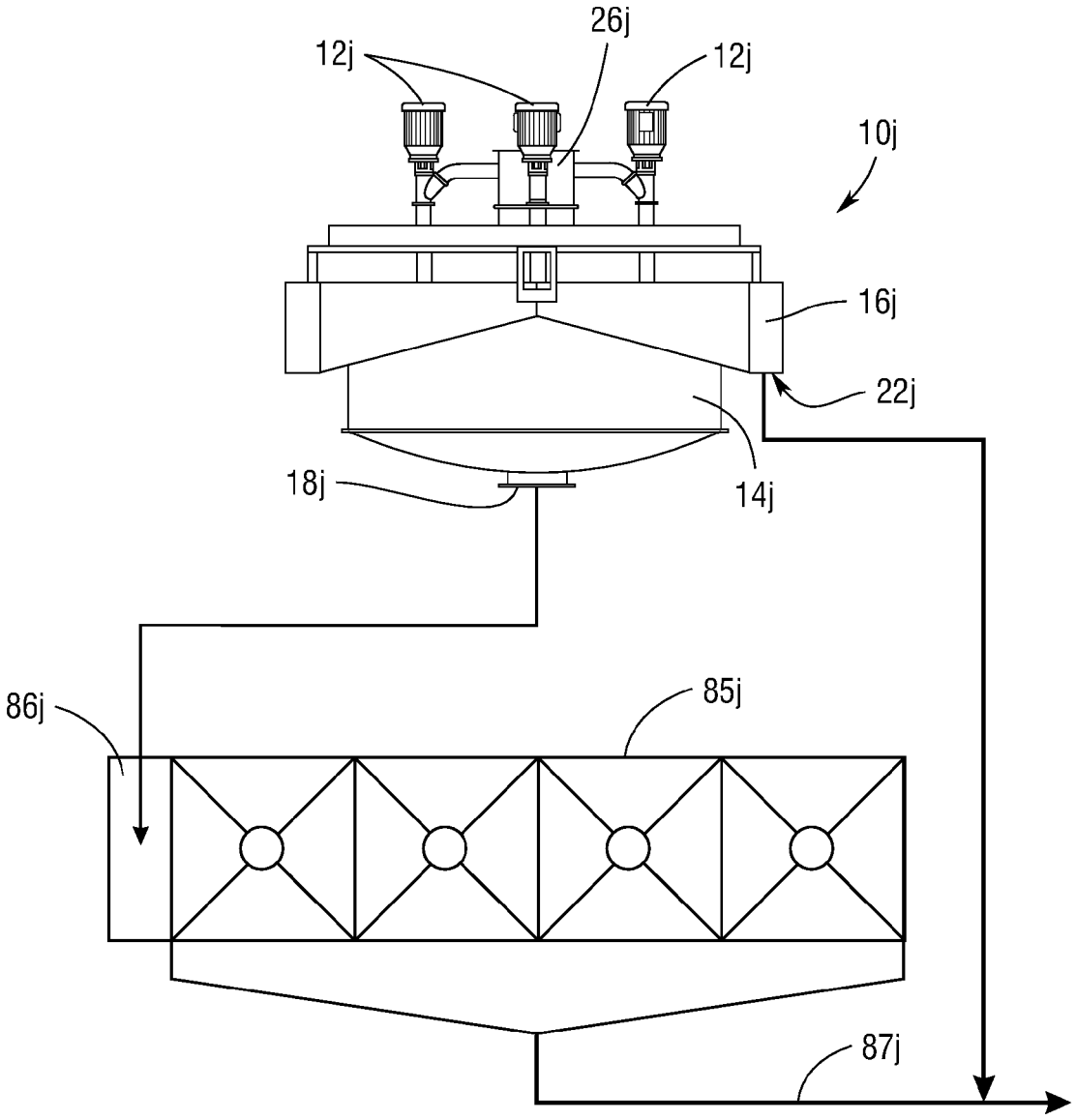
FIG. 16A shows a flotation separation system in which a flotation separation cell discharges slurry from the underflow removal port to the inlet of a conventional flotation cell.

The small footprint required for the flotation separation cell 10*j* suggests that it can be used to relieve the loading on existing conventional flotation cells 85*j* as shown for example in FIG. 16A. In such an arrangement, slurry that has been processed in the flotation separation cell 10*j* and discharged through the underflow removal port 18*j* is fed to the inlet 86*j* of a conventional flotation cell 85*j*. Collected froth from the flotation separation cell's 10*j* overflow launder 16*j* and overflow drain 22*j* is combined with product collected from the conventional flotation cell's 85*j* discharge 87*j*. As a significant portion of the hydrophobic species in the slurry has been removed by the flotation separation cell 10*j*, the reduced loading to the conventional flotation cell 85*j* leads to an overall increase in its performance and an improved overall recovery percentage of the hydrophobic species from flotation separation.

Figure 16B:
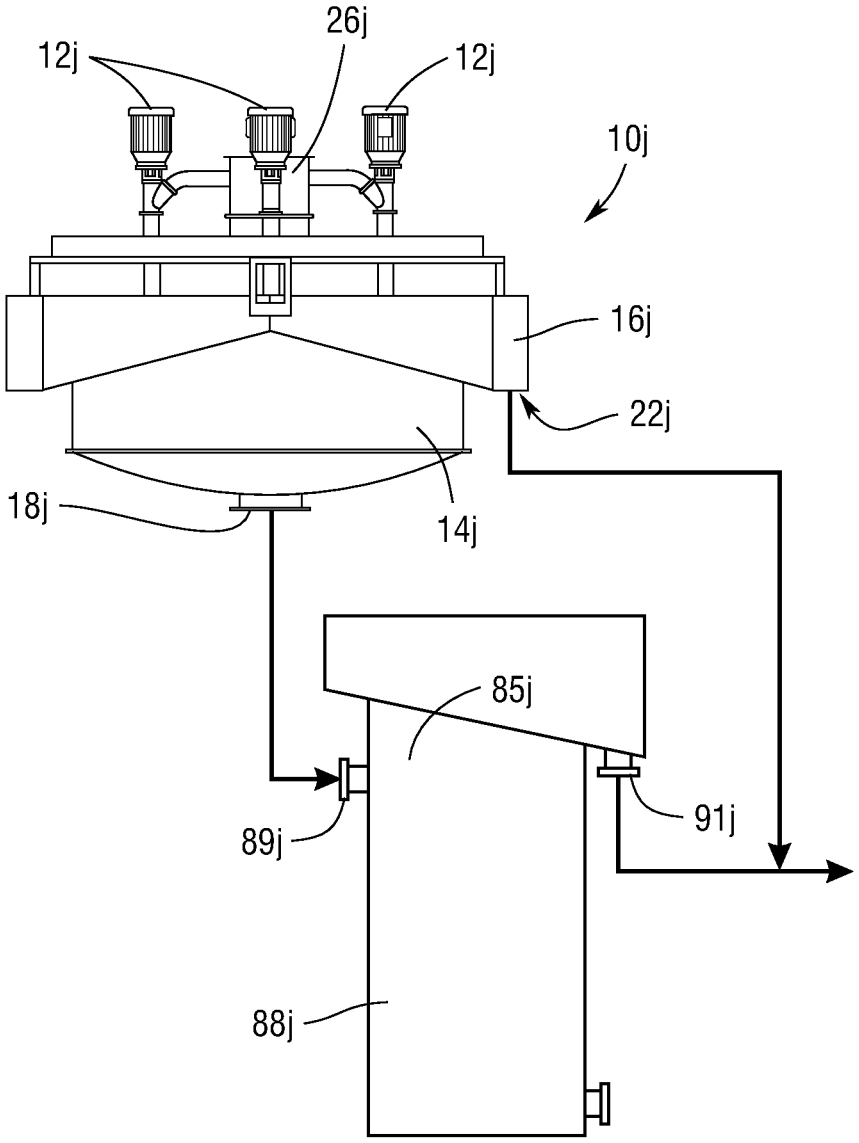
FIG. 16B shows a flotation separation system in which a flotation separation cell discharges slurry from the underflow removal port to the inlet of a column flotation cell.

Similarly, as shown in FIG. 16B, a flotation separation cell 10*j* can be located upstream of an existing column flotation cell 88*j*. In such an arrangement, slurry that has been processed in the flotation separation cell 10*j* and discharged through the underflow removal port 18*j* is fed to the inlet 89*j* of a conventional column flotation cell 88*j*. Collected froth from the flotation separation cell's 10*j* overflow launder 16*j* and overflow drain 22*j* is combined with product collected from the column flotation cell's 88*j* discharge 91*j*. As a significant portion of the hydrophobic species in the slurry has been removed by the flotation separation cell 10*j*, the reduced loading to the column flotation cell 88*j* leads to an overall increase in its performance and an improved overall recovery percentage of the hydrophobic species from flotation separation.

Figure 17A:
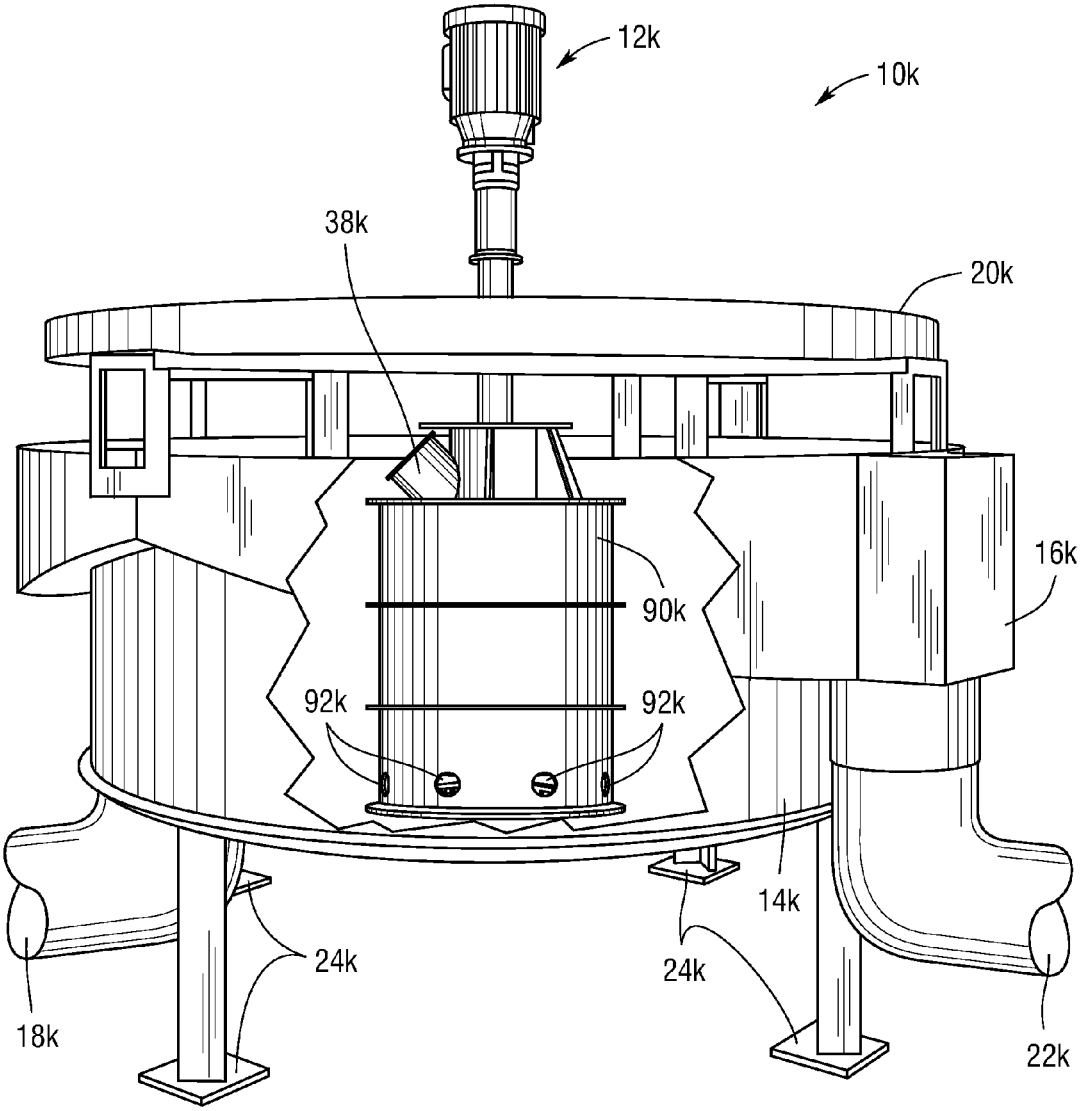
FIG. 17A shows an embodiment of a flotation separation cell that incorporates a center well.
Figure 17B:
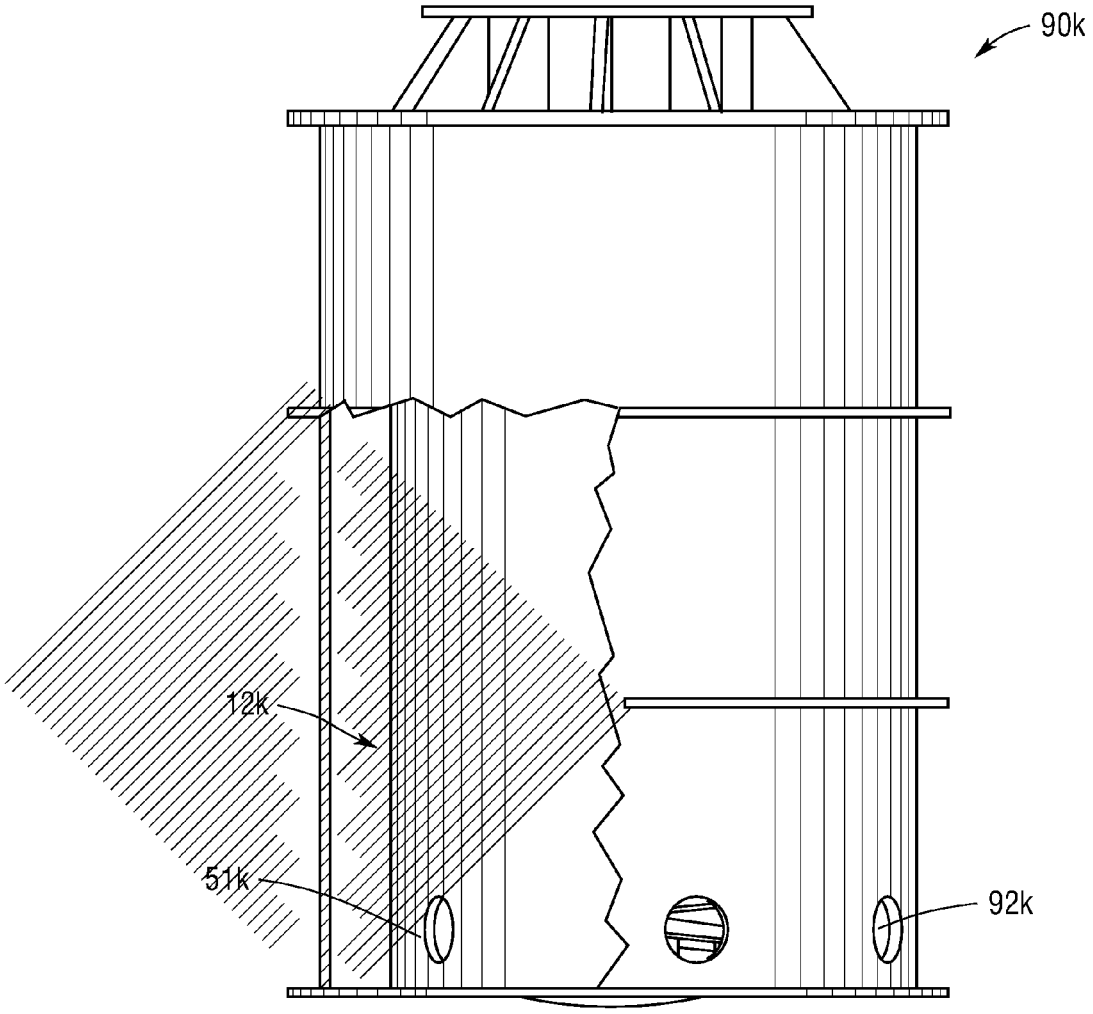
FIG. 17B shows the center well shown in FIG. 17A showing the sparger unit within the center well.

The pilot scale test indicated that there would be additional benefit to the flotation separation systems disclosed herein if a center well 90*k* were to be incorporated in the separation tank 14*k*, as shown in FIG. 17A. As can be best understood by comparing FIGS. 17A and 17B, the center well 90*k* fits around the outside of the sparger unit 12*k* and comprises a tube that runs the height of the separation tank 14*k*. Outlets 92*k* near the bottom of the center well 90*k* allow for the slurry discharged from the sparger unit 12*k* to enter the separation tank 14*k*.

The purpose of the center well 90*k* is to ensure that the sparger assembly within the center well 90*k* remains submerged below the liquid level and to aid in efficient bubble formation and promote efficient bubble/particle interaction. At low flows, the center well 90*k* liquid level will be at the same level as that of the surrounding separation tank 14*k*. However, at higher flows, the level within the center well 90*k* will be higher than that of the surrounding separation tank 14*k*. The higher level ensures that there is no chance for air to coalesce within the sparger unit 12*k* and ultimately reduces burping and inefficient contacting within the sparger unit 12*k*. The liquid level in the center well 90*k* can be determined by reading a low-pressure pressure gauge (not shown) that is installed on the slurry inlet 38*k*. In order to ensure that the center well 90*k* stays full, the center well 90*k* must be engineered such that it flushes just slightly slower than it fills. Only a positive pressure is required to indicate that the center well 90*k* is full.

Figure 18A:
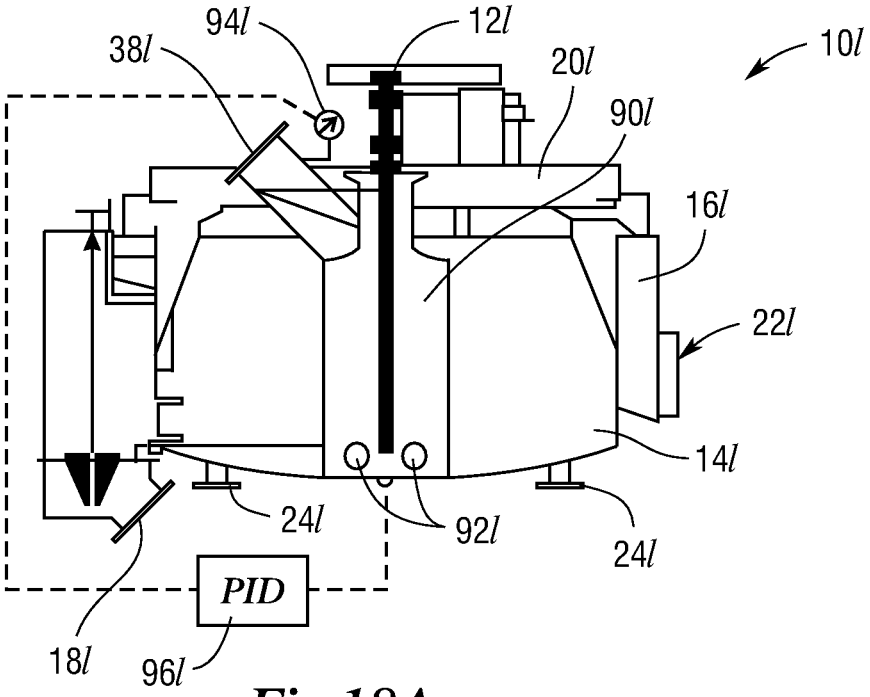
FIG. 18A shows a different embodiment of a flotation separation cell in which the center well liquid level is maintained by adjusting the size of the orifices at the end of the center well based on pressure sensor readings.
Figure 18B:
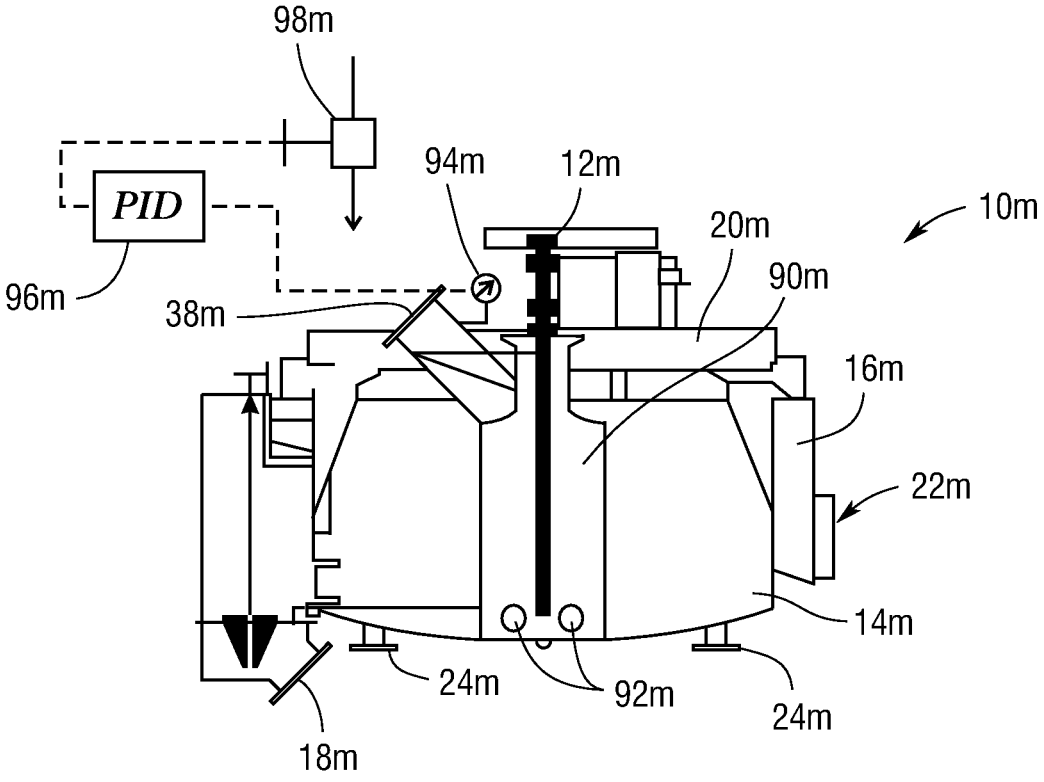
FIG. 18B shows a different embodiment of a flotation separation cell in which the liquid level in the center well is maintained by adjusting the inflow of slurry to the flotation separation cell.
Figure 18C:
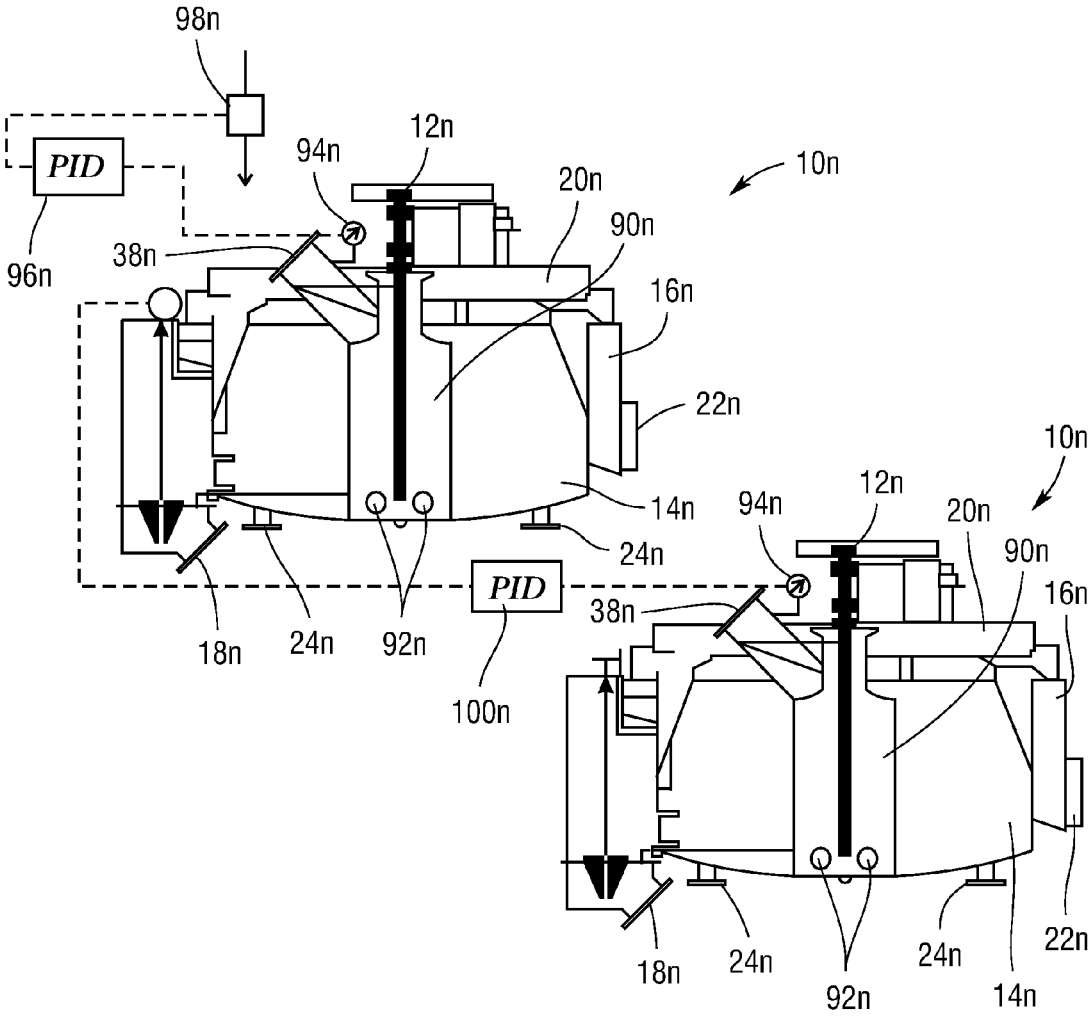
FIG. 18C shows a different embodiment of a flotation separation system comprising a number of flotation separation cells in series in which the liquid level in the center well for each flotation separation cell is maintained by adjusting the inflow of slurry to each flotation separation cell.

Level control in the center well can be maintained in several ways as shown in FIGS. 18A through 18C. As shown in FIG. 18A, the center well 90*l* is constructed such that the size of the outlets 92*l* can be continuously adjusted. A low-pressure gauge 94*l* installed at the slurry inlet 38*l* monitors the pressure in sparger unit 12*l*. A PID control loop 96*l* adjusts the outlet 92*l* size in response to changes in the pressure readings—an increase in pressure above a preset limit will trigger the PID control loop 96*l* to increase the outlet 92*l* size to allow more slurry to leave the sparger unit 12*l* and the center well 90*l*; a decrease in pressure below a preset limit will trigger the PID control loop 96*l* to decrease the outlet 92*l* size which will retain more slurry in the center well 90*l* and keep the sparger unit 12*l* submerged. It was contemplated that direct level control of the level of the separation tank 14*l* could be performed by using a PID process controller to throttle the outflow from the underflow nozzle 18*l* based on pressure readings in the separation tank 14*l*. While this method will ensure a consistent level in the separation tank 14*l*, it would not ensure that there is sufficient pressure within the center well 90*l*.

A simpler control scheme is shown in FIG. 18B that negates the need for a control mechanism to be placed within the separation tank 14*m*. In essence, the center well 90*m* level is maintained by controlling the flow from the inflow to the flotation separation system by automating a make-up valve 98*m* through a PID control loop 96*m* such that a low pressure reading from the low-pressure pressure gauge 94*m* triggers additional liquid, and hence flow, to be routed to the separation cell 10*m*.

This method can be easily applied to a series of separation tanks 10*n*, as shown in FIG. 18C. For the next cell in series for flotation separation systems that comprise a series of flotation separation cells 10*n*, a second PID control loop 100*n* controls the underflow nozzle 18*n* of the previous separation cell 10*n* in the series. These embodiments require only automation of the underflow nozzle 18*n* as per accepted industrial practice.

Figure 19:
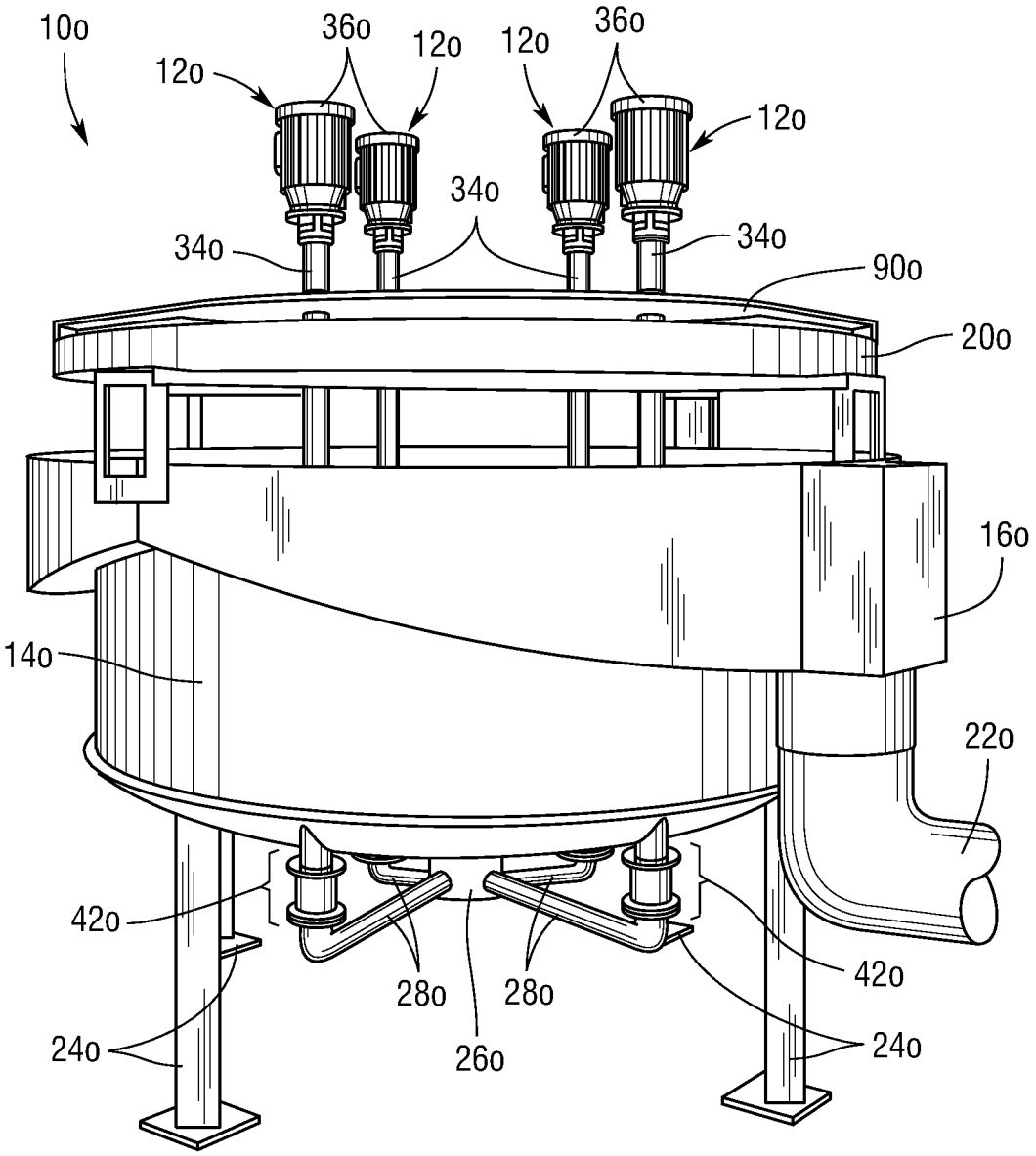
FIG. 19 is a perspective view of a flotation separation cell with four sparger units that feed slurry from the bottom of the separation tank.

Other designs of flotation separation cells are also possible. FIG. 19 shows a flotation separation cell 10*o* in which the slurry enters the sparger units 12*o* from underneath the separation tank 14*o*. A feed manifold distributor 26*o* distributes slurry to each sparger unit 12*o* through distributor pipes 28*o* to the sparging mechanisms 42*o*. Gas is supplied to the sparger units as described above. The electric motors 36*o* that power the rotating high-shear element (not shown) via rotating shafts 34*o* are located above the separation tank 14*o*. The electric motors 36*o* are supported in place with a support ring 90*o*. Slurry passes up through the sparging mechanism 42*o* and into the separation tank 14*o*.

Figure 20:
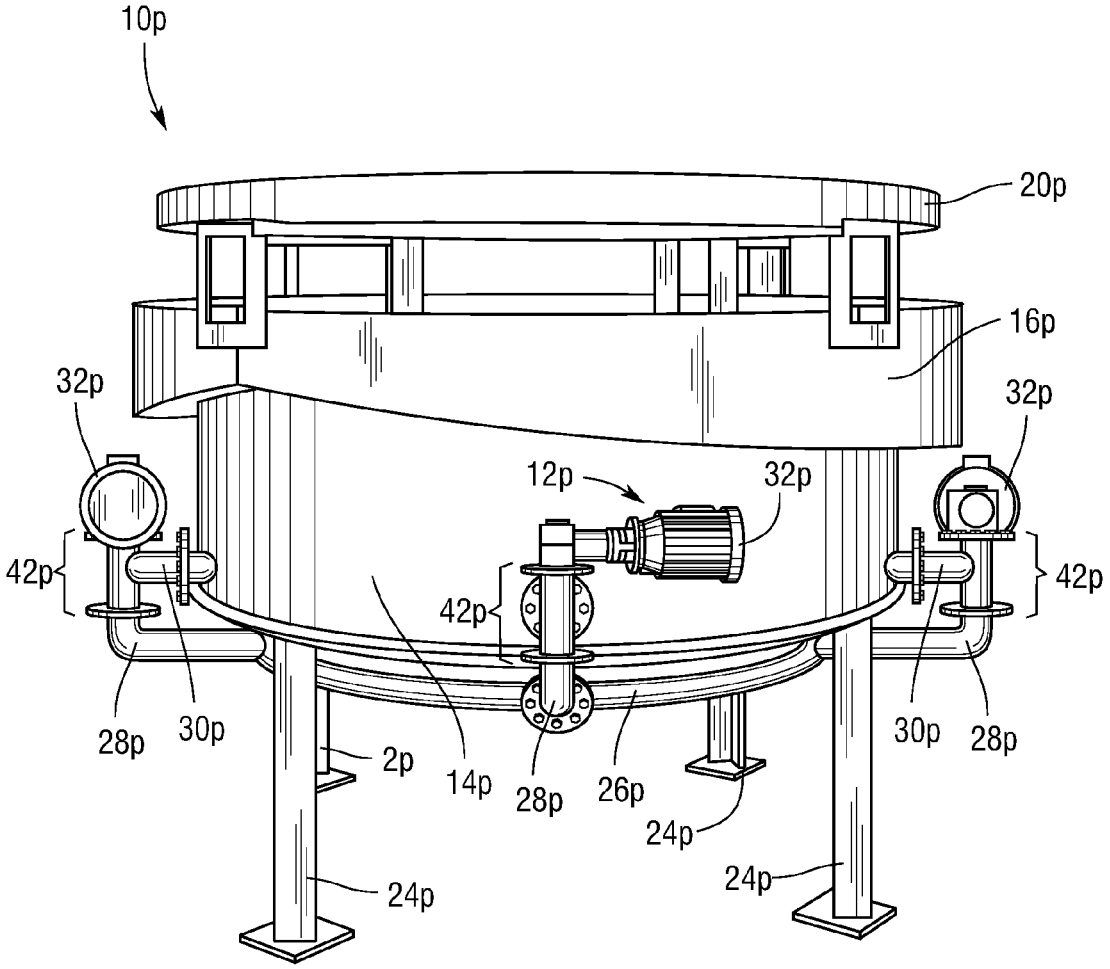
FIG. 20 is a perspective view of a flotation separation cell with four sparger units that feed slurry through the sidewalls of the separation tank.

FIG. 20 shows an embodiment of a flotation separation cell 10*p* in which the sparger units 12*p* are located on the side of the separation tank 14*p*. In this embodiment the feed manifold distributor 26*p* is shown feeding the sparger units 12*p* from underneath the separation tank 14*p*. The feed manifold distributor 26*p* can also be located above the separation tank 14*p* as shown in earlier embodiments.

Figure 21:
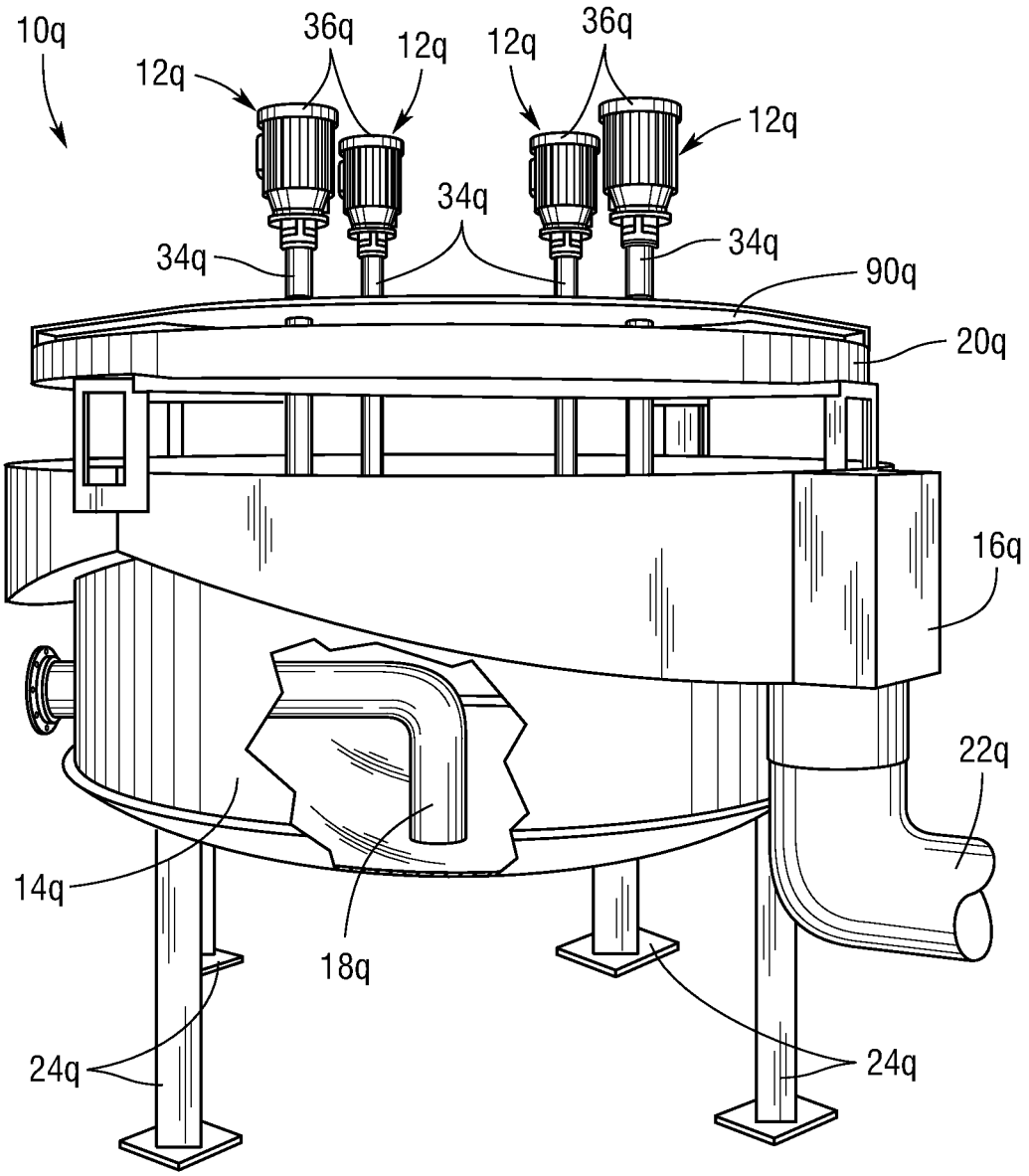
FIG. 21 is a perspective view of a flotation separation cell in which the underflow removal port leaves through the side of the separation tank.

The underflow removal port 18*q* does not need to be located at the bottom of the flotation separation cell 10*q*. The embodiment shown in FIG. 21 shows how the underflow removal port 18*q* can remove slurry from the side of the separation tank 14*q*. The underflow removal port 18*q* has a right angle bend directed towards the bottom of the separation tank 14*q* to allow for a uniform withdrawal of slurry from the bottom of the separation tank 14*q*. The slurry can be withdrawn from the underflow removal port 18*q* by gravity as a drain or with a pump, sand gates, an overflow weir system, or any other appropriate mechanism.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

What is claimed is:

1. A method of flotation separation for partitioning a slurry in a flotation separation system, the flotation separation system including a flotation separation cell, the flotation separation cell including a sparger unit and a separation tank, the sparger unit including a sparging mechanism that a substantially vertically oriented sparging mechanism housing having a separate inlet for a slurry inlet and a gas inlet at a first portion of said sparger mechanism housing and a slurry-gas mixture outlet at a second portion of said sparger mechanism housing, said sparger mechanism further comprises a rotating high-shear element within said sparging mechanism housing between said first portion and said second portion element, the effective open area in the sparging mechanism is substantially the same as the effective open area in the sparger unit upstream and downstream of the sparging mechanism, the sparging mechanism is configured such that slurry flow through it is substantially unrestricted, the rotating high-shear element for breaking up gas bubbles to increase the cumulative surface area of the gas bubbles, the slurry including a hydrophobic species which can adhere to gas bubbles formed in the slurry, said flotation separation method comprising:

introducing a slurry into the sparging unit;

introducing gas into the slurry in the sparging unit with at least enough pressure to form bubbles in the slurry;

sparging the gas in the slurry into a bubble dispersion with the sparging mechanism at a pressure in the sparging mechanism of about 10 psig or less, and subjecting said slurry and introduced gas to said rotating high-shear element to break up said introduced gas into finer gas bubbles; and discharging the slurry and the bubble dispersion from the sparger unit to the separation tank and allowing the bubble dispersion to form a froth at the top of the slurry contained in said separation tank.

2. The method of claim 1 further comprising passing the slurry through more than one flotation separation cell in series.

3. The method of claim 1 further comprising:

passing the slurry through more than one flotation separation cell in series; and separating the slurry from the froth in the separation tank of the last flotation separation cell in series and directing the slurry outside of the flotation separation system.

4. The method of claim 1 further comprising:

passing the slurry through more than one flotation separation cell in series;

separating a portion of the slurry from the froth in the separation tank of the last flotation separation cell in series and directing the portion of the slurry to the first separation tank in series; and directing the remaining slurry outside of the flotation separation system.

5. The method of claim 1 further comprising adding additives to the slurry to modify the chemistry of the slurry.

6. The method of claim 1 further comprising adding additives to the slurry to modify the chemistry of the slurry, the additives from the group consisting of a surface tension modifier, a collector, an extender, a depressant, and a pH modifier.

7. The method of claim 1 further comprising introducing slurry and bubble dispersion into the separation tank at several locations within the separation tank.

8. The method of claim 1 further comprising washing the froth that rises to the top of the separation tank.

9. The method of claim 1 in which the pressure in the sparging mechanism is about 1 psig or less.

10. The method of claim 1 in which the slurry is introduced to the sparger unit at a hydraulic pressure of about 2 psig or less.

* * * * *